US010983470B2

(12) United States Patent
Gima

(10) Patent No.: US 10,983,470 B2
(45) Date of Patent: Apr. 20, 2021

(54) IMAGE FORMING APPARATUS

(71) Applicant: Oki Data Corporation, Tokyo (JP)

(72) Inventor: Satoshi Gima, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 266 days.

(21) Appl. No.: 16/280,302

(22) Filed: Feb. 20, 2019

(65) Prior Publication Data

US 2019/0332039 A1 Oct. 31, 2019

(30) Foreign Application Priority Data

Feb. 27, 2018 (JP) ..... JP2018-033535

(51) Int. Cl.
*G03G 15/00* (2006.01)

(52) U.S. Cl.
CPC ..... *G03G 15/5062* (2013.01); *G03G 15/6517* (2013.01); *G03G 15/6523* (2013.01)

(58) Field of Classification Search
CPC ..... G03G 15/6523; G03G 15/5054; B41J 11/663
See application file for complete search history.

(56) References Cited

U.S. PATENT DOCUMENTS

2010/0290800 A1* 11/2010 Akiyama ..... G03G 15/5058 399/66
2014/0086605 A1* 3/2014 Yoshida ..... G03G 15/16 399/45
2015/0068377 A1* 3/2015 Chanclon ..... B26D 5/00 83/37
2015/0165792 A1* 6/2015 Kudo ..... B26D 1/185 347/16
2017/0248872 A1* 8/2017 Kitamura ..... G03G 15/161

FOREIGN PATENT DOCUMENTS

JP 2017-215365 A 12/2017

* cited by examiner

*Primary Examiner* — Jennifer E Simmons
(74) *Attorney, Agent, or Firm* — Panitch Schwarze Belisario & Nadel LLP

(57) ABSTRACT

An image forming apparatus includes a first conveyor, a cutter, a second conveyor, a detection image forming section, a detector, and a controller. The first conveyor conveys a print medium. The cutter cuts the conveyed print medium. The second conveyor conveys, in a first direction, the print medium cut by the cutter. The detection image forming section forms a detection image on the print medium and the second conveyor. The detector detects, at two positions in a second direction, the detection image formed on the print medium or the detection image formed on the second conveyor. The controller varies one or both of a conveying speed of the print medium to be conveyed by the first conveyor and a cutting speed of the print medium to be cut by the cutter, on the basis of a comparison of the detection image detected at the two positions.

13 Claims, 19 Drawing Sheets

IMAGE FORMING APPARATUS

CROSS REFERENCE TO RELATED APPLICATIONS

The present application claims priority from Japanese Patent Application No. 2018-033535 filed on Feb. 27, 2018, the entire contents of which are hereby incorporated by reference.

BACKGROUND

The technology relates to an image forming apparatus that cuts a print medium and forms an image on a surface of the cut print medium.

An image forming apparatus based on an electrophotographic method is in widespread use. The image forming apparatus based on the electrophotographic method forms an image on a surface of a print medium, and is able to achieve a higher-quality image in a shorter time as compared with an image forming apparatus based on any other method such as an inkjet method.

Some proposals have been made on a configuration of the image forming apparatus based on the electrophotographic method, such as an image forming apparatus provided with a cutter in order to cut a print medium. For example, reference is made to Japanese Unexamined Patent Application Publication No. 2017-215365. The image forming apparatus provided with the cutter cuts a print medium by means of the cutter while conveying the print medium, and thus forms an image on a surface of the print medium cut by the cutter.

SUMMARY

Various proposals have been made on a configuration of an image forming apparatus provided with a cutter. However, a configuration of such an image forming apparatus has not been sufficient in terms of stably forming an image on a print medium while utilizing the cutter, which still leaves room for improvement.

It is desirable to provide an image forming apparatus that makes it possible to stably forms an image on a print medium.

An image forming apparatus according to one embodiment of the technology includes: a first conveyor that conveys a print medium, a cutter that cuts the print medium conveyed by the first conveyor; a second conveyor that conveys, in a first direction, the print medium cut by the cutter; a detection image forming section that forms a detection image on each of the print medium cut by the cutter and the second conveyor; a detector that detects, at two positions that are in a second direction, one of the detection image formed on the print medium cut by the cutter and the detection image formed on the second conveyor, in which the second direction is substantially orthogonal to the first direction; and a controller that varies one or both of a conveying speed of the print medium to be conveyed by the first conveyor and a cutting speed of the print medium to be cut by the cutter, on a basis of a comparison of the detection image detected at the two positions by the detector.

An image forming apparatus according to one embodiment of the technology includes: a first conveyor that conveys a print medium; a cutter that cuts the print medium conveyed by the first conveyor; a second conveyor that conveys, in a first direction, the print medium cut by the cutter; a detection image forming section that forms a detection image on the print medium cut by the cutter; a detector that detects, at two positions that are in a second direction, the detection image, in which the second direction is substantially orthogonal to the first direction; and a controller that varies one or both of a conveying speed of the print medium to be conveyed by the first conveyor and a cutting speed of the print medium to be cut by the cutter, on a basis of a comparison of the detection image detected at the two positions by the detector.

DETAILED DESCRIPTION

Figure 1:
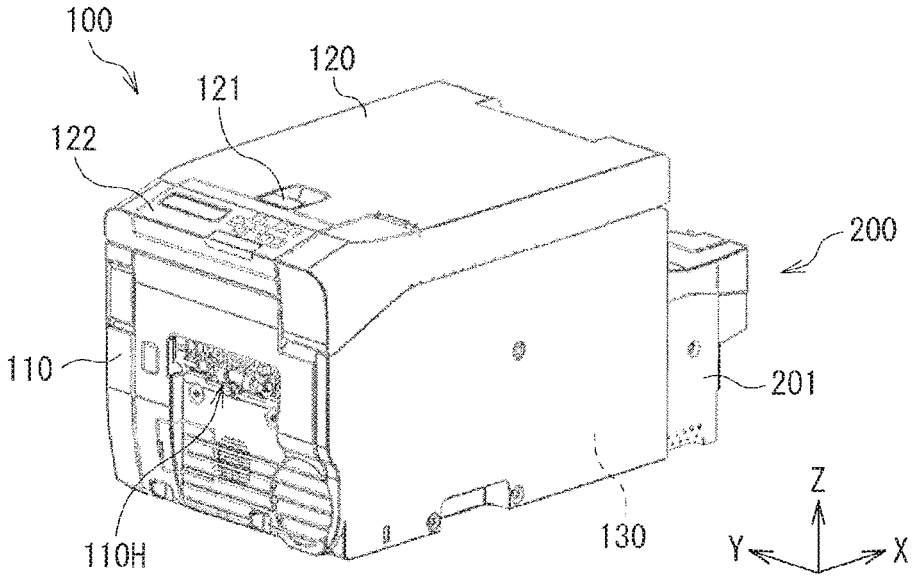
FIG. 1 is a perspective view of an example of a configuration of an image forming apparatus according to one embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description will be given in the following order.

1. Image Forming Apparatus (First Example Embodiment)
   1-1. General Configuration
   1-2. Block Configuration
   1-3. Configurations of Toner Image
   1-4. Principle of Controlling Conveying Speed and Cutting Speed
   1-5. Operation
   1-6. Example Workings and Example Effects
2. Image Forming Apparatus (Second Example Embodiment)
   2-1. Configuration
   2-2. Operation
   2-3. Example Workings and Example Effects
3. Image Forming Apparatus (Third Example Embodiment)
   3-1. Configuration
   3-2. Operation
   3-3. Example Workings and Example Effects
4. Image Forming Apparatus (Fourth Example Embodiment)
5. Modification Examples

1. IMAGE FORMING APPARATUS (FIRST EXAMPLE EMBODIMENT)

A description is given below of an image forming apparatus according to a first example embodiment of the technology.

Figure 2:
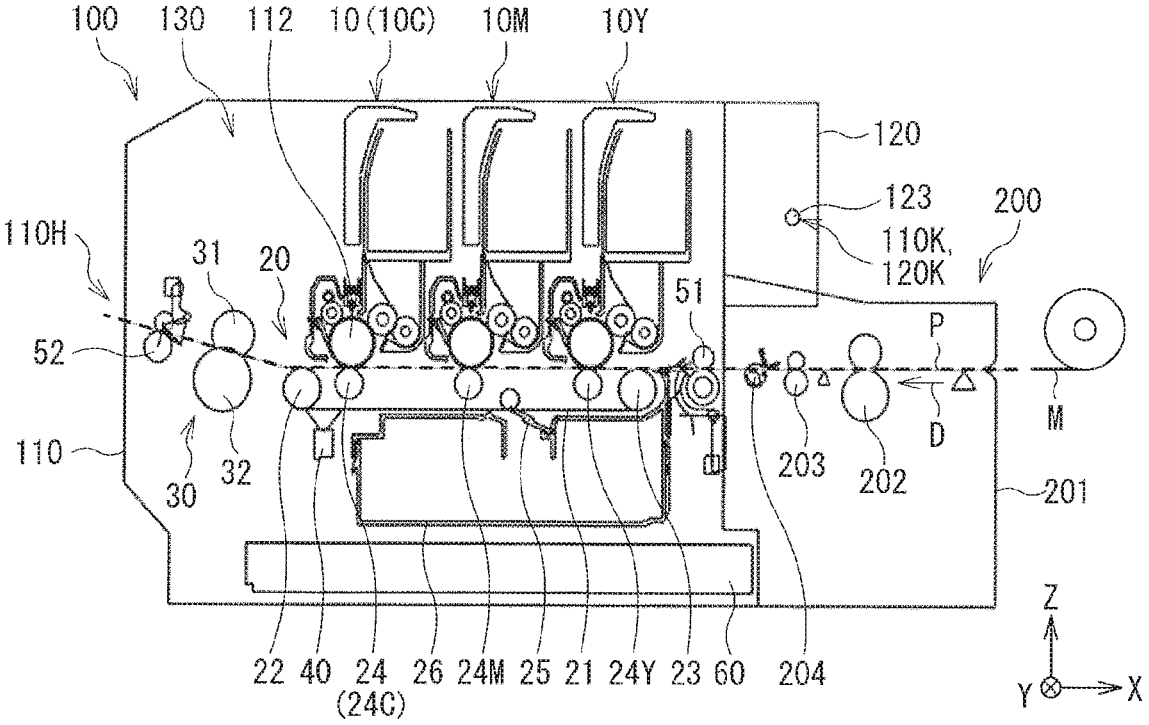
FIG. 2 is a schematic plan view of an example of a configuration of the image forming apparatus illustrated in FIG. 1.
Figure 3:
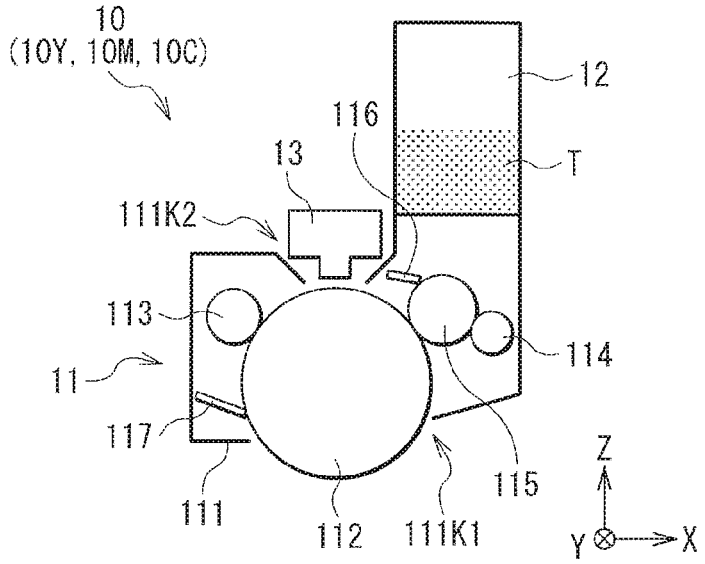
FIG. 3 is an enlarged plan view of an example of a configuration of a developing unit illustrated in FIG. 2.

The image forming apparatus according to the first example embodiment may form an image on a print medium M with the use of a toner T illustrated in FIG. 3. The print medium M will be described later with reference to FIG. 2. The image forming apparatus may be, for example, a full-color printer based on a so-called electrophotographic method.

The image forming apparatus cuts the print medium M, and forms an image on a surface of the cut print medium M. In an example embodiment, the print medium M may be a roll of print medium M. However, the print medium M does not necessarily have to be rolled in the form of the roll as long as the print medium M is subjected to a cutting process.

It is to be noted that any type of print medium M may be used and hence the print medium M is not particularly limited in its type accordingly. In a specific but non-limiting embodiment, the print medium M may include one or more of materials such as paper or a film.

[1-1. General Configuration]

A description is given first of an example of a general configuration of the image forming apparatus according to the first example embodiment.

Figure 4:
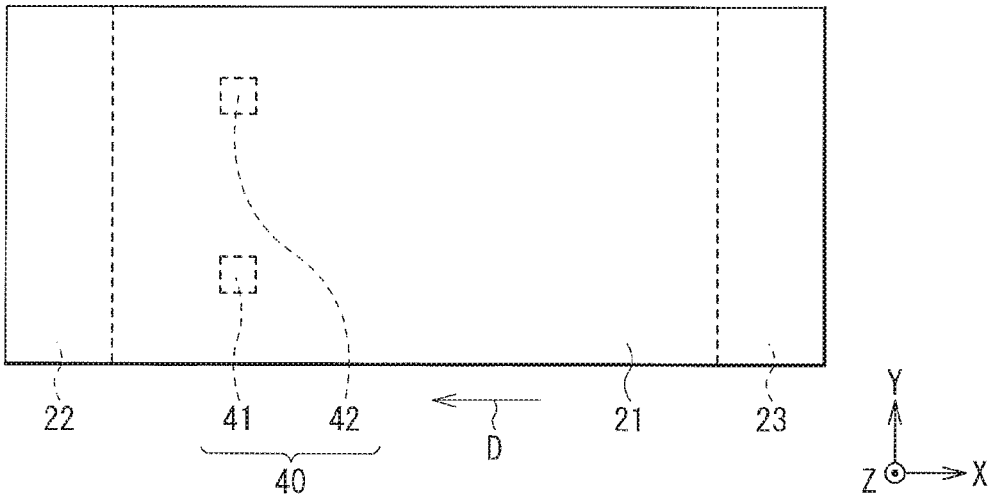
FIG. 4 is an enlarged plan view of an example of a configuration of a transfer section illustrated in FIG. 2.

FIG. 1 illustrates an example of a perspective configuration of the image forming apparatus according to the first example embodiment. FIG. 2 schematically illustrates an example of a plan configuration of the image forming apparatus illustrated in FIG. 1. FIG. 3 illustrates, in an enlarged fashion, an example of a plan configuration of a developing unit 10 illustrated in FIG. 2. FIG. 4 illustrates, in an enlarged fashion, an example of a configuration of a transfer section 20 illustrated in FIG. 2, together with image detection sensors 40.

In the following description, the upper side, the lower side, the left side, and the right side of the image forming apparatus illustrated in FIG. 1 are respectively referred to as upper (or the upper side), lower (or the lower side), front (or the front side), and rear (or the rear side).

Referring to FIGS. 1 and 2, the image forming apparatus may include an image forming unit 100 and a medium feeding unit 200, for example.

[Image Forming Unit]

The image forming unit 100 may form an image on the surface of the print medium M fed from the medium feeding unit 200.

The image forming unit 100 may have an image forming device 130 provided in a housing 110. For example, the housing 110 may be attached with a top cover 120.

The housing 110 may contain the image forming device 130. For example, the housing 110 may be a box-shaped member having an opening at an upper part of the housing 110 as illustrated in FIGS. 1 and 2. The housing 110 may have a discharge opening 110H at a front face of the housing 110. For example, the discharge opening 110H may discharge the print medium M on which an image has been formed.

The top cover 120 may cover the opening of the housing 110 in which the image forming device 130 is disposed. For example, the top cover 120 may be a plate-shaped member as illustrated in FIGS. 1 and 2, and may be openable on an as-needed basis. The top cover 120 may have an upper face that is provided with an opening-closing lever 121, for example. The opening-closing lever 121 may serve as a holding member that allows the top cover 120 to be opened or closed. The top cover 120 may have a front face that is provided with an operation interface panel 122, for example. The operation interface panel 122 may be operated by a user upon using the image forming apparatus, and will be described later in greater detail.

The housing 110 may have a through hole 110K provided at a rear part of the housing 110. The top cover 120 may also have a through hole 120K provided at a rear part of the top cover 120. For example, the through holes 110K and 120K each may extend in a Y-axis direction. A shaft 123 may be inserted into the through holes 110K and 120K. For example, the shaft 123 may be a rod-shaped member, and may extend in the Y-axis direction. With this example configuration, the top cover 120 may be pivotable around the shaft 123 and may be openable and closable accordingly.

[Image Forming Device]

The image forming device 130 may form an image on the surface of the print medium M with use of the toner T. Referring to FIG. 2, the image forming device 130 may include a developing unit 10, a transfer section 20, a fixing section 30, the image detection sensors 40, conveying rollers 51 and 52, and a control board 60, for example. The print medium M to be fed from the medium feeding unit 200 to the image forming unit 100, e.g., to the image forming device 130, may be conveyed in a conveyance direction D along a conveyance route P. For example, the print medium M may be conveyed in an X-axis direction along the conveyance route P that is denoted by a broken line in FIG. 2. The X-axis direction may correspond to a specific but non-limiting example of a "first direction" in one embodiment of the technology. The image detection sensor 40 may correspond to a specific but non-limiting example of a "detector" in one embodiment of the technology.

[Developing Unit]

The developing unit 10 may perform a developing process, i.e., a process of attaching the toner T to an electrostatic latent image. For example, the developing unit 10 may form the electrostatic latent image, and attach the toner T to the electrostatic latent image by utilizing Coulomb force.

As described later in greater detail, the developing unit 10, when the print medium M is cut by a cutter 204, forms a toner image G on the surface of the print medium M cut by the cutter 204 and on a surface of a conveyance belt 21. In other words, the toner image G may include a medium toner image GA and a conveyance toner image GB. In an example embodiment, the developing unit 10 may form the medium toner image GA on the surface of the print medium M. and form the conveyance toner image GB on the surface of the conveyance belt 21. The medium toner image GA and the conveyance toner image GB each may correspond to a specific but non-limiting example of a "detection image" in one embodiment of the technology.

For example, the developing unit 10 may cause, by means of a transfer roller 24, the toner T to be transferred from the surface of the print medium M through a cut edge MT to the surface of the conveyance belt 21 in the conveyance direction D, upon conveyance by the conveyance belt 21 of the print medium M cut by the cutter 204. By performing such a transfer operation, the developing unit 10 may form the toner image G as illustrated in FIGS. 6 to 14. The thus-formed toner image G may include the medium toner image GA formed on the surface of the print medium M and the conveyance toner image GB formed on the surface of the conveyance belt 21 as described above. A configuration of the toner image G, including the medium toner image GA and the conveyance toner image GB, will be described later in greater detail.

Any number of developing units 10 may be provided and hence the number of developing units 10 is not particularly limited. In an illustrated example embodiment, the image forming device 130 may include three developing units 10, i.e., developing units 10Y, 10M, and 10C. The developing units 10Y, 10M, and 10C each may be attached detachably to the housing 110, and may be disposed in this order from upstream toward downstream along the conveyance route P.

Referring to FIG. 3, the developing units 10Y, 10M, and 10C each may include a developing process unit 11 and a toner cartridge 12, for example. The toner cartridge 12 may be attached detachably to the developing process unit 11, for example. The developing process unit 11 may be provided with a light source 13, for example. In an example embodiment, the developing units 10Y. 10M, and 10C may have configurations same as or similar to each other except for the toners T contained in the respective toner cartridges 12. For example, the toners T may be different in type (e.g., color) from each other.

The developing process unit 11 may perform the developing process with the use of the toner T fed from the toner cartridge 12. The developing process unit 11 may include a photosensitive drum 112, a charging roller 113, a feeding roller 114, a developing roller 115, a developing blade 116, and a cleaning blade 117 that are provided in the housing 111, for example.

The housing 111 may have an opening 111K1 from which the photosensitive drum 112 is partially exposed, for example. The housing 111 may also have an opening 111K2 that allows light outputted from the light source 13 to be guided to the photosensitive drum 112. The light source 13 may be disposed outside of the housing 111, for example.

The photosensitive drum 112 may be a cylindrical member including an organic photoreceptor that supports the electrostatic latent image. The photosensitive drum 112 may extend in the Y-axis direction, and be rotatable around a rotation axis that extends in the Y-axis. The charging roller 113 may be so pressed against the photosensitive drum 112 as to be in contact with the photosensitive drum 112. The charging roller 113 may electrically charge a surface of the photosensitive drum 112. The feeding roller 114 may be so pressed against the developing roller 115 as to be in contact with the developing roller 115. The feeding roller 114 may feed the toner T to a surface of the developing roller 115. The developing roller 115 may be so pressed against the photosensitive drum 112 as to be in contact with the photosensitive drum 112. The developing roller 115 may support the toner T that is fed from the feeding roller 114, and attach the fed toner T onto the electrostatic latent image formed on the surface of the photosensitive drum 112.

Note that, among the components of the image forming apparatus, any component referred to by the name that contains the term "roller", such as the charging roller 113 described above, may be a cylindrical member that extends in the Y-axis direction and is rotatable around the rotation axis that extends in the Y-axis. The same holds true in the following description for any component referred to by the name that contains the term "roller".

The developing blade 116 may be a plate-like member that controls a thickness of the toner T fed to the surface of the developing roller 115. The developing blade 116 may be disposed at a position away from the developing roller 115 with a predetermined distance, i.e., predetermined spacing, in between, for example. The thickness of the toner T may be controlled on the basis of the distance, i.e., the spacing, between the developing roller 115 and the developing blade 116.

The cleaning blade 117 may be a plate-like elastic member that scrapes off an extraneous material such as unnecessary remains of the toner T that are present on the surface of the photosensitive drum 112. The cleaning blade 117 may extend in a direction substantially parallel to a direction in which the photosensitive drum 112 extends, for example. The cleaning blade 117 may be so pressed against the photosensitive drum 112 as to be in contact with the photosensitive drum 112.

The toner cartridge 12 may contain the toner T. The toner cartridge 12 provided in the developing unit 10Y may contain a yellow toner, for example. The toner cartridge 12 provided in the developing unit 10M may contain a magenta toner, for example. The toner cartridge 12 provided in the developing unit 10C may contain a cyan toner, for example.

The light source 13 may be an exposure device that performs exposure on the surface of the photosensitive drum 112 to thereby form the electrostatic latent image on the surface of the photosensitive drum 112. The light source 13 may be, for example, a light-emitting diode (LED) head that has components including an LED element and a lens array. The LED element and the lens array may be so disposed that the light outputted from the LED element forms an image on the surface of the photosensitive drum 112, for example.

[Transfer Section]

The transfer section 20 may perform a transfer process of the toner T that has been subjected to the developing process by the developing unit 10. For example, the transfer section 20 may transfer, onto the print medium M, the toner T that has been attached to the electrostatic latent image by the developing unit 10.

The transfer section 20 may include the conveyance belt 21, a driving roller 22, a driven roller 23, the transfer roller 24, a cleaning blade 25, and a collection box 26, for example. Note that FIG. 4 illustrates only the conveyance belt 21, the driving roller 22, and the driven roller 23. The developing unit 10 and the transfer roller 24 may correspond to a specific but non-limiting example of a "detection image forming section" in one embodiment of the technology. The conveyance belt 21 may correspond to a specific but non-limiting example of a "second conveyor" in one embodiment of the technology.

The conveyance belt 21 may convey, in the conveyance direction D, the print medium M cut by the later-described cutter 204. The conveyance belt 21 may be an elastic endless belt, for example. The conveyance belt 21 may be able to travel in accordance with rotation of the driving roller 22, while lying on the driving roller 22 and the driven roller 23 in a stretched state, for example. The driving roller 22 may be rotatable, for example, by utilizing power of a device such as a motor. The driven roller 23 may be rotatable in accordance with the rotation of the driving roller 22, for example.

The transfer roller 24 may transfer, onto the print medium M, the toner T attached to the electrostatic latent image. The transfer roller 24 may be so pressed against the photosensitive drum 112 as to be in contact with the photosensitive drum 112 with the conveyance belt 21 in between. The number of transfer rollers 24 is not particularly limited. For example, the number of transfer rollers 24 may correspond to the number of developing units 10. In an illustrated example embodiment, the image forming apparatus may include three transfer rollers 24 including transfer rollers 24Y, 24M, and 24C, corresponding to the three developing units 10 including the developing units 10Y, 10M, and 10C.

The cleaning blade 25 may be so pressed against the conveyance belt 21 as to be in contact with the conveyance belt 21. The cleaning blade 25 may scrape off an extraneous material such as unnecessary remains of the toner T on the surface of the conveyance belt 21. The collection box 26 may collect the extraneous material scraped by the cleaning blade 25.

[Fixing Section]

The fixing section 30 may perform a fixing process of the toner T that has been transferred onto the print medium M by the transfer section 20. For example, the fixing section 30 may apply a pressure onto the print medium M onto which the toner T has been transferred by the transfer section 20, while heating the print medium M. The fixing section 30 may thereby fix the toner T to the print medium M.

The fixing section 30 may include a heating roller 31 and a pressure applying roller 32, for example. The heating roller 31 may heat the toner T having been transferred onto the print medium M. The heating roller 31 may have a heating source such as a heater 80 (see FIG. 5) disposed inside the heating roller 31, for example. A temperature measuring device such as a later-described thermistor (see FIG. 5) may be so disposed in the vicinity of the heating roller 31 that the heating roller 31 and the temperature measuring device such as the thermistor may be spaced apart from each other, for example. The pressure applying roller 32 may be so pressed against the heating roller 31 as to be in contact with the heating roller 31. The pressure applying roller 32 may apply a pressure onto the toner T transferred onto the print medium M.

[Image Detection Sensor]

The image detection sensors 40 may be disposed away from each other in a width direction that intersects the conveyance direction D. For example, the image detection sensors 40 may be disposed in the width direction (e.g., the Y-axis direction) that is substantially orthogonal to the conveyance direction D. The Y-axis direction may correspond to a specific but non-limiting example of a "second direction" in one embodiment of the technology. In the present example embodiment, for example, the width direction may be orthogonal to the conveyance direction D. The image detection sensors 40 may detect the toner image G at two positions that are different from each other in the width direction.

In an example embodiment, the image detection sensors 40 may detect the conveyance toner image GB formed on the conveyance belt 21, out of the above-described toner image G including the medium toner image GA and the conveyance toner image GB. For example, the image detection sensors 40 may be disposed below the conveyance belt 21. In a specific but non-limiting embodiment, the image detection sensors 40 each may be disposed at a position that is upstream of a position at which formation of the toner image G starts and that is downstream of a position at which the formation of the toner image G ends, in a traveling direction of the conveyance belt 21. Accordingly, the conveyance belt 21 may be disposed in a region between the developing unit 10 and the image detection sensors 40, for example.

The image detection sensors 40 may be disposed away from each other in the width direction as described above. Hence, in an example embodiment, the image detection sensors 40 may detect, on the basis of the conveyance toner image GB, positions of the conveyance toner image GB at two positions that are different from each other in the width direction. In such an example embodiment, the image detection sensors 40 may detect, at the respective two positions, timings at which the detection of the conveyance toner image GB is started. In an alternative example embodiment, the image detection sensors 40 may detect, at the respective two positions, formation sizes of the conveyance toner image GB, on the basis of the conveyance toner image GB. For example, the image detection sensors 40 may detect, as a non-limiting example of the formation size, lengths of the conveyance toner image GB in the conveyance direction D. In such an alternative example embodiment, the image detection sensors 40 may detect, at the respective two positions, timings at which the detection of the conveyance toner image GB is started and timings at which the detection of the conveyance toner image GB is ended. Some non-limiting examples of the detection to be performed by the image detection sensors 40 will be described later in greater detail.

The number of image detection sensors 40 are not particularly limited as long as two or more image detection sensors 40 are provided. In an illustrated example embodiment, the number of image detection sensors 40 may be two, i.e., the image detection sensors 40 may include image detection sensors 41 and 42 as illustrated in FIG. 4. For example, the image detection sensors 40 may include image detection sensors 41 and 42 that are disposed away from each other in the width direction. The image detection sensor 41 and the image detection sensor 42 may respectively detect a later-described toner image G1 (e.g., the conveyance toner image GB) and a later-described toner image G2 (e.g., the conveyance toner image GB) as illustrated by way of example in FIGS. 6 to 14, for example. A distance or an interval between the image detection sensor 41 and the image detection sensor 42 is not particularly limited. However, in an example embodiment, the interval between the image detection sensor 41 and the image detection sensor 42 may be sufficiently large to allow for easier calculation, with high accuracy, of a starting time difference ΔTS, an ending time difference ΔTE, and a detection time difference ΔTC that are described later in greater detail. The image detection sensor 41 may correspond to a specific but non-limiting example of a "first detector" in one embodiment of the technology. The image detection sensor 42 may correspond to a specific but non-limiting example of a "second detector" in one embodiment of the technology.

The image detection sensors 40 are each not limited in its kind as long as the image detection sensors 40 are able to detect the toner image G, e.g., the conveyance toner image GB. In an example embodiment, the image detection sensors 40 each may include an optical device that is able to detect presence of the toner image G by means of a reflection phenomenon of light. For example, the image detection sensors 40 each may include a photosensor. The photosensor may be able to output an output value that corresponds to a concentration of the toner image G, in order to allow for the detection of the presence of the toner image G that serves as a detection target, for example.

[Conveying Rollers]

The conveying roller 51 and the conveying roller 52 may convey the print medium M in the conveyance direction D along the conveyance route P as with the conveyance belt 21. For example, the conveying rollers 51 and 52 each may include a pair of rollers that face each other with the conveyance route P in between. The conveyance belt 21 may be disposed between the conveying rollers 51 and 52, for example.

[Control Board]

The control board 60 may have a central processing unit (CPU), for example. The control board 60 may control the image forming apparatus as a whole. A configuration of the control board 60, including a block configuration, will be described later in greater detail with reference to FIG. 5.

[Medium Feeding Unit]

The medium feeding unit 200 may feed the print medium M to the image forming unit 100. In an example embodiment, the medium feeding unit 200 may cut the rolled print medium M, and may thereafter convey the cut medium M along the conveyance route P, thereby feeding the print medium M, having been subjected to the cutting, from the medium feeding unit 200 to the image forming unit 100. For example, the medium feeding unit 200 may be attached at a rear part of the image forming unit 100.

The medium feeding unit 200 in an example embodiment may have a conveying roller 202, a conveying roller 203, and the cutter 204 that are disposed in a housing 201, for example. The conveying rollers 202 and 203 and the cutter 204 may be disposed in this order from upstream to downstream of the conveyance route P. The conveying rollers 202 and 203 may correspond to a specific but non-limiting example of a "first conveyor" in one embodiment of the technology. The cutter 204 may correspond to a specific but non-limiting example of a "cutter" in one embodiment of the technology.

[Conveying Rollers]

The conveying roller 202 and the conveying roller 203 may convey the rolled print medium M along the conveyance route P and thereby convey the rolled print medium M to the cutter 204. For example, the conveying rollers 202 and 203 each may include a pair of rollers that face each other with the conveyance route P in between, as with the conveying rollers 51 and 52.

[Cutter]

The cutter 204 may so cut the rolled print medium M conveyed by the conveying rollers 202 and 203 as to cause the cut print medium M to have a predetermined size, e.g., a predetermined length. In an example embodiment, the cutter 204 may include a rotary cutter. The rotary cutter may extend in the Y-axis direction, and may be rotatable around a rotation axis that extends in the Y-axis direction. For example, the rotary cutter may be rotatable and cut the print medium M upon the conveyance of the rolled print medium M by the conveying rollers 202 and 203. Thus, the cutter 204, including the rotary cutter in an example embodiment, may be able to cut the rolled print medium M while conveying the rolled print medium M. The print medium M following the cutting by the cutter 204 may thus have the cut edge MT, as described later in greater detail with reference to FIGS. 6 to 14.

[1-2. Block Configuration]

A description is given next of an example of a block configuration of the image forming apparatus according to an example embodiment.

Figure 5:
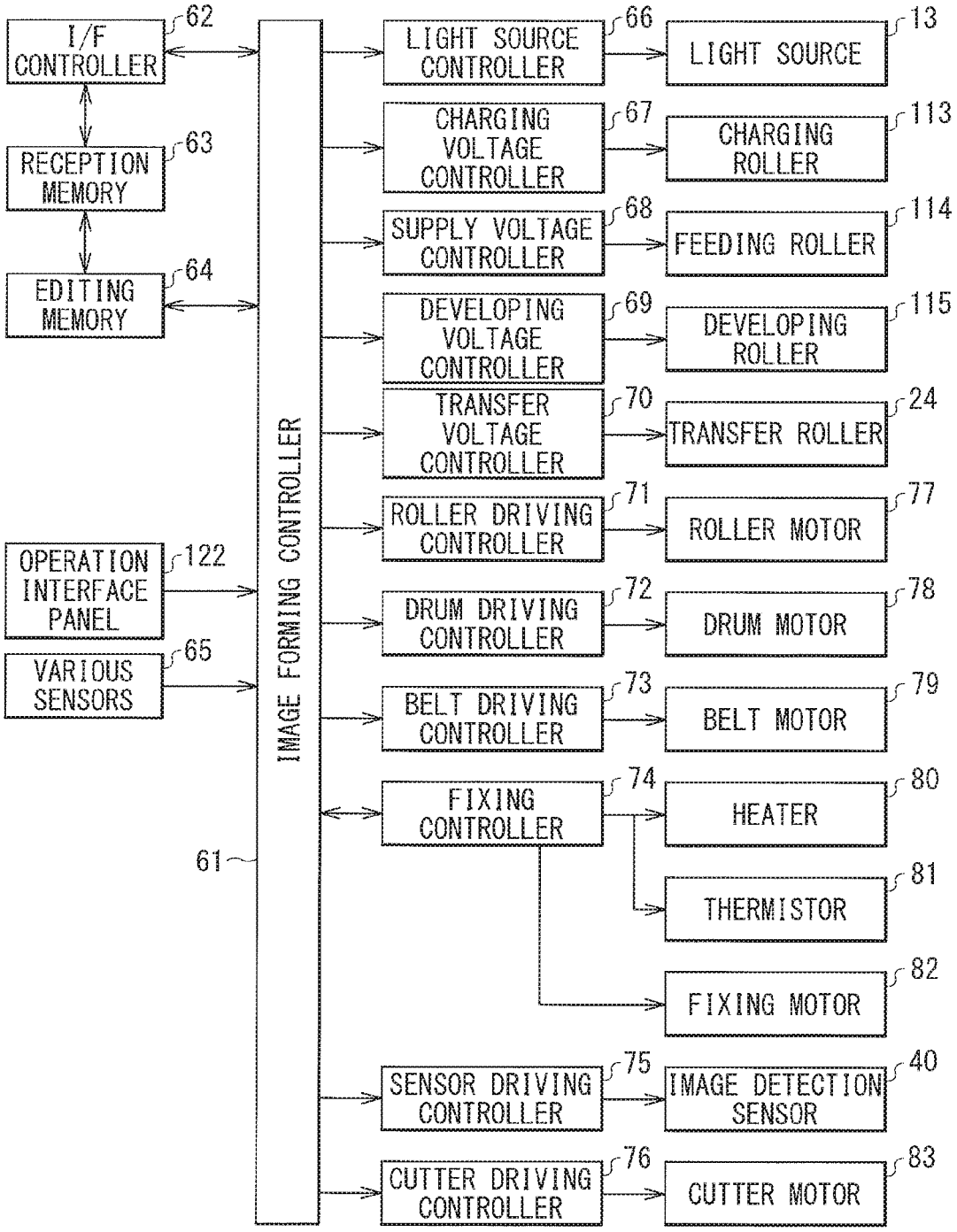
FIG. 5 is a block diagram illustrating an example of a configuration of the image forming apparatus illustrated in FIG. 2.

FIG. 5 illustrates an example of the block configuration of the image forming apparatus illustrated in FIG. 2, together with some of the components of the image forming apparatus that are already described above.

Referring to FIG. 5, the image forming apparatus, or the control board 60, may have an image forming controller 61, an interface (I/F) controller 62, a reception memory 63, an editing memory 64, various sensors 65, a light source controller 66, a charging voltage controller 67, a supply voltage controller 68, a developing voltage controller 69, a transfer voltage controller 70, a roller driving controller 71, a drum driving controller 72, a belt driving controller 73, a fixing controller 74, a sensor driving controller 75, and a cutter driving controller 76, for example.

[Image Forming Controller]

The image forming controller 61 may control an operation of the image forming apparatus as a whole. The image forming controller 61 may have one or more of electronic components including, but not limited to, a control circuit, a memory, an input/output port, and a timer. For example, the control circuit may include a device such as CPU. For example, the memory may include one or more of memory devices including, but not limited to, a read-only memory (ROM) and a random-access memory (RAM). The image forming controller 61 may correspond to a specific but non-limiting example of a "controller" in one embodiment of the technology.

The image forming controller 61 varies one or both of a conveying speed of the print medium M to be conveyed by the conveying rollers 202 and 203 and a cutting speed of the print medium M to be cut by the cutter 204. The image forming controller 61 varies one or both of the conveying speed and the cutting speed on the basis of a comparison of the conveyance toner image GB detected, at the two positions that are different from each other in the width direction, by the image detection sensors 40, e.g., by the image detection sensors 41 and 42. Some non-limiting examples of a principle of controlling the conveying speed and the cutting speed to be performed by the image forming controller 61 will be described later in greater detail with reference to FIGS. 15 to 19.

[I/F Controller]

The I/F controller 62 may receive information such as data transmitted from an external apparatus to the image forming apparatus. For example, the external apparatus may be any device usable by a user of the image forming apparatus, such as a personal computer. The information to be transmitted from the external apparatus to the image forming apparatus may be any data directed to formation of an image, such as image data.

[Reception Memory and Editing Memory]

The reception memory 63 may store information such as data received by the image forming apparatus. For example, the data may be the above-described image data. The editing memory 64 may store information such as image data having been subjected to an editing process.

[Operation Interface Panel]

The operation interface panel 122 may serve both as a display and an input device, for example. The display may display any information necessary for the user to operate the image forming apparatus. The input device may be used by the user to operate the image forming apparatus. The operation interface panel 122 may include members including a display panel and an operation button. The display panel may be a liquid crystal panel having a touch panel functionality, although a kind of the display panel is not particularly limited.

[Various Sensors]

The various sensors 65 may include one or more of sensors including, but not limited to, a temperature sensor, a humidity sensor, an image density sensor, a medium position detection sensor, a toner remaining level detection sensor, and a human sensor. It is to be noted that the various sensors 65 do not encompass the image detection sensors 40.

[Light Source Controller, Charging Voltage Controller, Supply Voltage Controller, Developing Voltage Controller, and Transfer Voltage Controller]

The light source controller 66 may control an operation related to the light source 13, such as an exposure operation of the light source 13, for example. The charging voltage controller 67 may control a voltage, such as a voltage to be applied to the charging roller 113, for example. The supply voltage controller 68 may control a voltage, such as a voltage to be applied to the feeding roller 114, for example. The developing voltage controller 69 may control a voltage, such as a voltage to be applied to the developing roller 115, for example. The transfer voltage controller 70 may control a voltage, such as a voltage to be applied to the transfer roller 24, for example. For example, these voltages may be set in accordance with instructions issued from the image forming controller 61.

In an illustrated example embodiment, the image forming apparatus may include three light source controllers 66 corresponding to the respective three developing units 10 including the developing units 10Y, 10M, and 10C. Note that those three light source controllers 66 are not illustrated in FIG. 5 for simplification purpose. For example, the three light source controllers 66 may be the light source controller 66 that controls the light source 13 provided in the developing unit 10Y, the light source controller 66 that controls the light source 13 provided in the developing unit 10M, and the light source controller 66 that controls the light source 13 provided in the developing unit 10C.

In an illustrated example embodiment, what has been described above in relation to the light source controllers 66 may apply, for example, to the charging voltage controller 67, the supply voltage controller 68, the developing voltage controller 69, and the transfer voltage controller 70 as well. For example, the image forming apparatus according to an illustrated example embodiment may include three charging voltage controllers 67, three supply voltage controllers 68, three developing voltage controllers 69, and three transfer voltage controllers 70 that are provided corresponding to the three developing units 10, for example.

[Roller Driving Controller, Drum Driving Controller. Belt Driving Controller. Fixing Controller. Sensor Driving Controller, and Cutter Driving Controller]

The roller driving controller 71 may control an operation related to the rollers. For example, the roller driving controller 71 may control, through the use of the roller motors 77, an operation of rotating a series of rollers including the conveying rollers 51, 52, 202, and 203, the charging roller 113, the feeding roller 114, the developing roller 115, and the transfer roller 24. The drum driving controller 72 may control an operation related to the photosensitive drum 112. For example, the drum driving controller 72 may control, through the use of a drum motor 78, an operation of rotating the photosensitive drum 112. The belt driving controller 73 may control an operation related to the conveyance belt 21. For example, the belt driving controller 73 may control, through the use of a belt motor 79, an operation of causing the conveyance belt 21 to travel. The fixing controller 74 may control an operation related to a fixing operation. For example, the fixing controller 74 may control an operation of the heater 80 on the basis of a temperature measured by the thermistor 81, and may also control, through the use of fixing motors 82, an operation of rotating each of the heating roller 31 and the pressure applying roller 32. The sensor driving controller 75 may control an operation related to the image detection sensors 40. For example, the sensor driving controller 75 may control a detection operation to be performed by the image detection sensors 40. The sensor driving controller 75 may output, to the image forming controller 61, detection results obtained by the image detection sensors 40. The cutter driving controller 76 may control an operation related to the cutter 204. For example, the cutting driving controller 76 may control, through the use of a cutter motor 83, a cutting operation to be performed by the cutter 204.

In an illustrated example embodiment, what has been described above in relation to the light source controllers 66 may apply, for example, to the roller driving controller 71 and the drum driving controller 72 as well. For example, the image forming apparatus according to an illustrated example embodiment may include three roller driving controllers 71 and three drum driving controllers 72 that are provided corresponding to the three developing units 10, for example. The three roller driving controllers 71 each may control the operation that involves the use of roller motors 77. For example, the three roller driving controllers 71 may control the respective operations of rotating the rollers including the three transfer rollers 24, i.e., the transfer rollers 24Y, 24M, and 24C.

[1-3. Configurations of Toner Image]

A description is given next of some non-limiting examples of a configuration of the toner image G to be formed by the image forming apparatus according to an example embodiment.

FIGS. 6 to 14 each illustrate an example of a plan configuration of elements including the print medium M and the conveyance belt 21 for describing an example configuration of the toner image G, and each correspond to FIG. 4.

It is to be noted that FIGS. 6 to 14 each illustrate a state in which the print medium M, having been subjected to the cutting of the rolled print medium M by the cutter 204, is conveyed by the conveyance belt 21.

Figure 6:
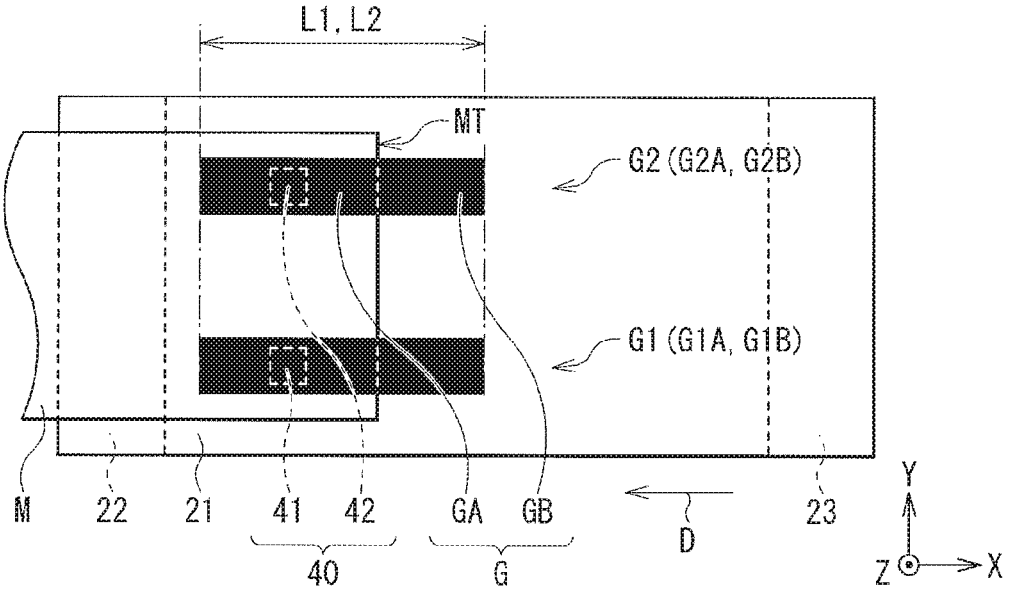
FIG. 6 is a plan view for describing a configuration of a toner image according to a first configuration example.

It is to be also noted that FIG. 6 illustrates a state in which the print medium M has been cut by the cutter 204 normally and the cut edge MT formed on the print medium M extends in the width direction, accordingly. FIGS. 7 to 14 each illustrate a state in which the print medium M has not been cut by the cutter 204 normally, e.g., cut obliquely by the cutter 204, and the cut edge MT extends obliquely relative to the width direction, accordingly.

As described previously, the image forming apparatus may form the toner image G, e.g., the medium toner image GA and the conveyance toner image GB, on the surface of the print medium M and the surface of the conveyance belt 21 upon the conveyance, by the conveyance belt 21, of the print medium M cut by the cutter 204, for example.

The toner image G is not particularly limited in its configuration as long as the toner T is transferred from the surface of the print medium M through the cut edge MT to the surface of the conveyance belt 21 in the conveyance direction D as described above. Non-limiting examples of the configuration of the toner image G may include the number of toner images G, a length of the toner image G (e.g., a formation size in the conveyance direction D), and a shape of a pattern of the toner image G.

In an illustrated example embodiment, the number of toner images G may be two, i.e., may include two toner images G1 and G2, as illustrated in FIGS. 6 to 14. For example, the toner image G may include the toner image G1 and the toner image G2 that are disposed away from each other in the width direction. Accordingly, the toner image G1 may include a medium toner image G1A and a conveyance toner image G1B, for example, whereas the toner image G2 may include a medium toner image G2A and a conveyance toner image G2B, for example. In an example embodiment, a length L1 of the toner image G1 and a length L2 of the toner image G2 may be equal to each other, for example. The medium toner image G1A may correspond to a specific but non-limiting example of a "first detection image" in one embodiment of the technology. The medium toner image G2A may correspond to a specific but non-limiting example of a "second detection image" in one embodiment of the technology. The conveyance toner image G1B may correspond to a specific but non-limiting example of the "first detection image" in one embodiment of the technology. The conveyance toner image G2B may correspond to a specific but non-limiting example of the "second detection image" in one embodiment of the technology.

In an example embodiment, the toner image G may extend continuously from the surface of the print medium M through the cut edge MT to the surface of the conveyance belt 21 in the conveyance direction D. In an alternative example embodiment, the toner image G may extend discontinuously, e.g., intermittently, from the surface of the print medium M through the cut edge MT to the surface of the conveyance belt 21 in the conveyance direction D. For example, the toner image G may have any of a series of pattern shapes as illustrated by way of example in FIGS. 6 to 14 as the pattern shape of the toner image G. In an example embodiment, the toner image G1 and the toner image G2 may have their respective pattern shapes that are same as each other. Note that, in an alternative example embodiment, two or more of the series of patterns illustrated by way of example in FIGS. 6 to 14 may be combined in any combination.

Figure 7:
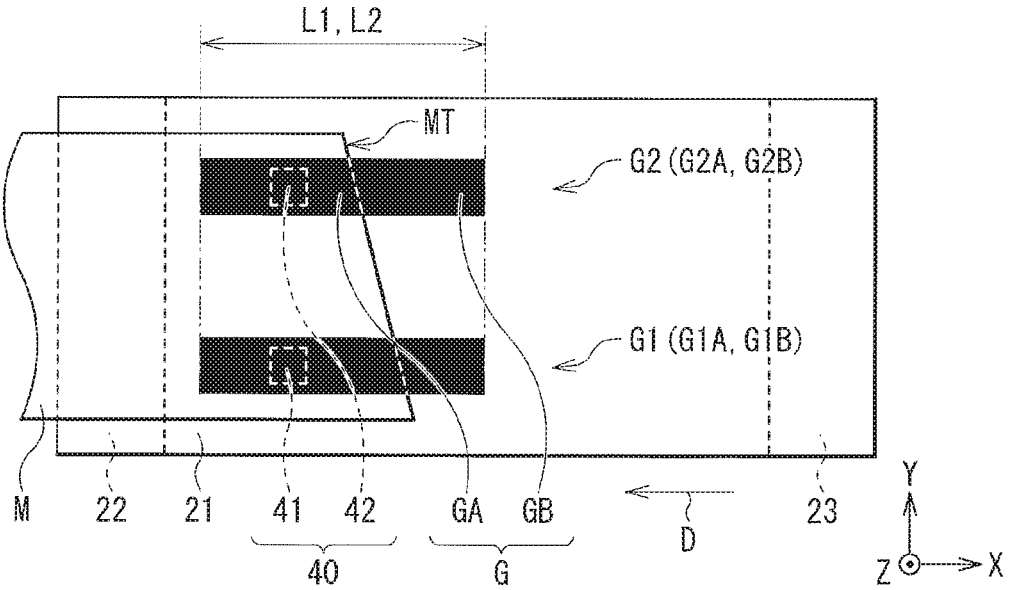
FIG. 7 is another plan view for describing the configuration of the toner image according to the first configuration example.
Figure 8:
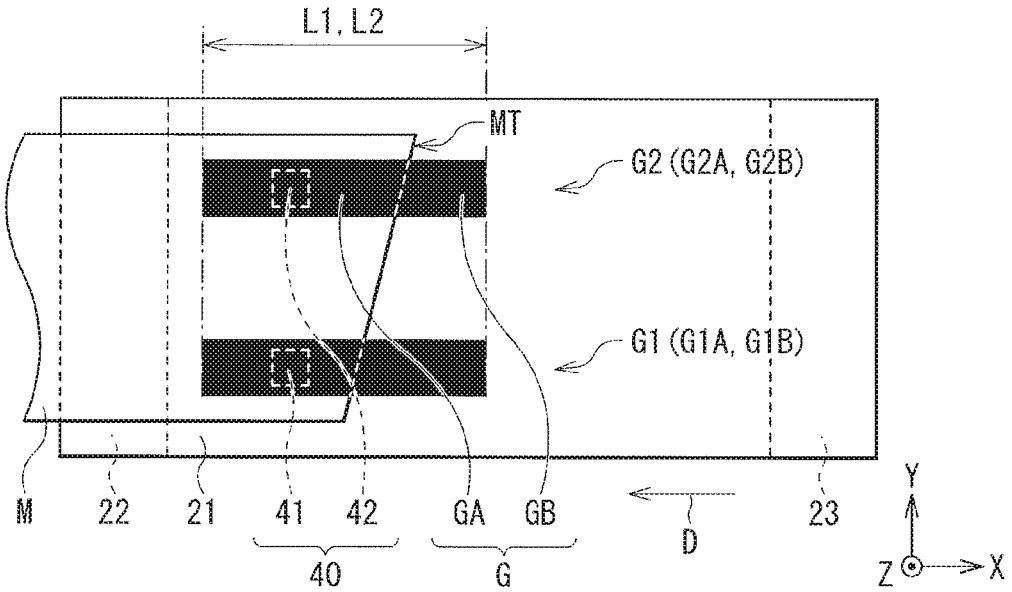
FIG. 8 is yet another plan view for describing the configuration of the toner image according to the first configuration example.
Figure 9:
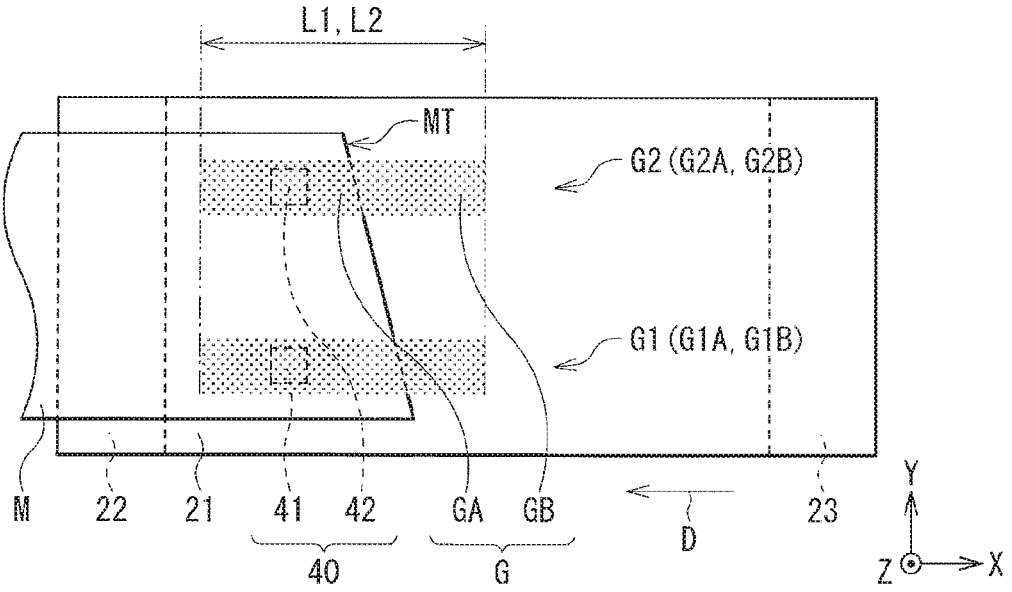
FIG. 9 is a plan view for describing a configuration of the toner image according to a second configuration example.
Figure 10:
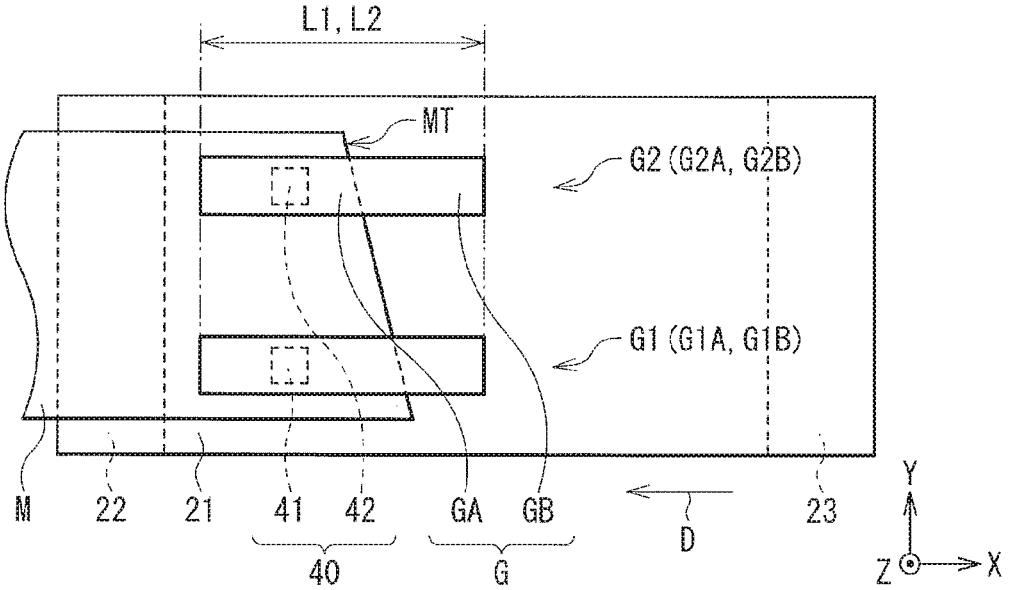
FIG. 10 is a plan view for describing a configuration of the toner image according to a third configuration example.
Figure 11:
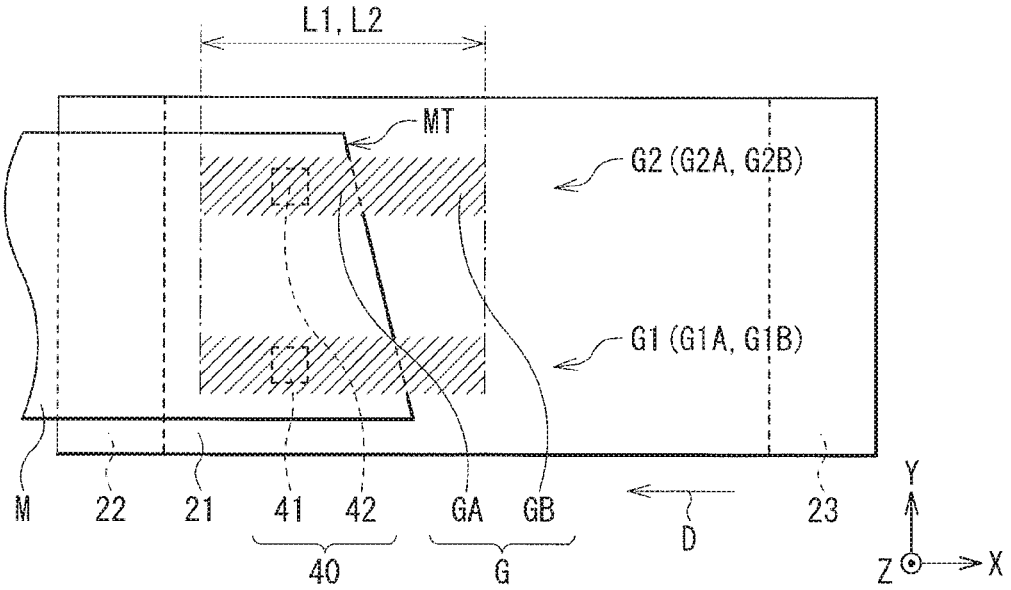
FIG. 11 is a plan view for describing a configuration of the toner image according to a fourth configuration example.
Figure 12:
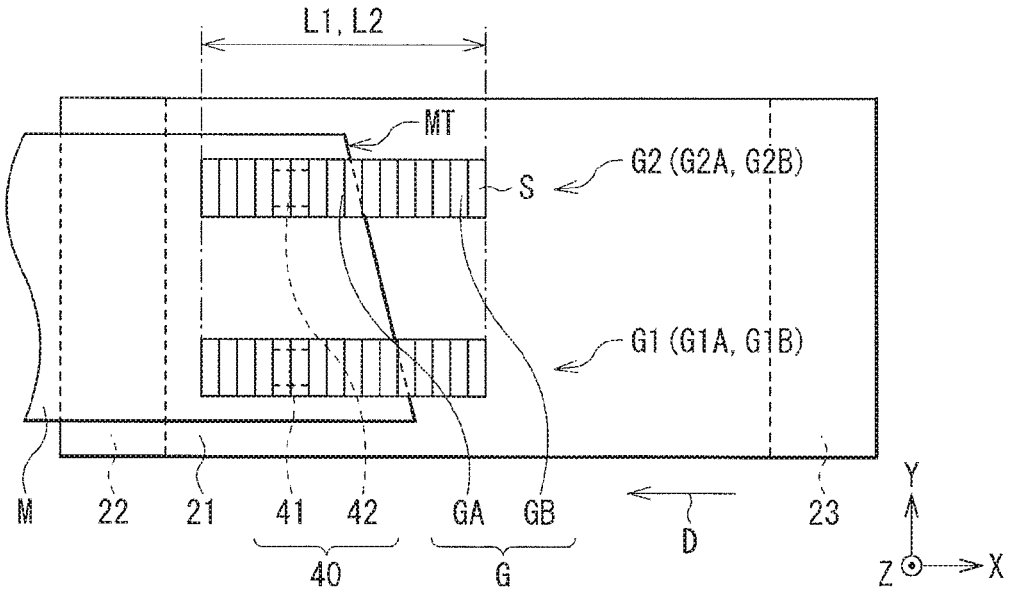
FIG. 12 is a plan view for describing a configuration of the toner image according to a fifth configuration example.

FIGS. 6 to 8 each illustrate an example embodiment in which the toner image G has, as the pattern shape, a rectangular solid pattern that extends continuously in the conveyance direction D. FIG. 9 illustrates an example embodiment in which the toner image G has, as the pattern shape, a rectangular pattern having dots that extends continuously in the conveyance direction D. FIG. 10 illustrates an example embodiment in which the toner image G has, as the pattern shape, a rectangular frame pattern that extends continuously in the conveyance direction D. FIG. 11 illustrates an example embodiment in which the toner image G has, as the pattern shape, a rectangular ruled pattern that extends continuously in the conveyance direction D. FIG. 12 illustrates an example embodiment in which the toner image G has, as the pattern shape, a rectangular scaled pattern that extends continuously in the conveyance direction D. For example, the toner image G in the example embodiment illustrated in FIG. 12 may have a plurality of frame-shaped scales S that are so arrayed as to be adjacent to each other in the conveyance direction D.

Figure 13:
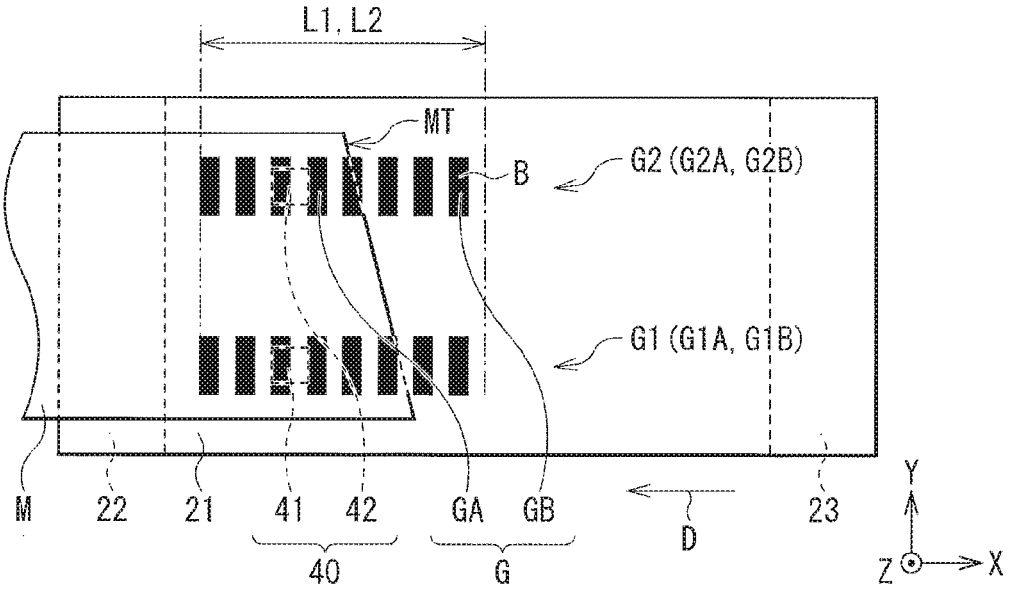
FIG. 13 is a plan view for describing a configuration of the toner image according to a sixth configuration example.
Figure 14:
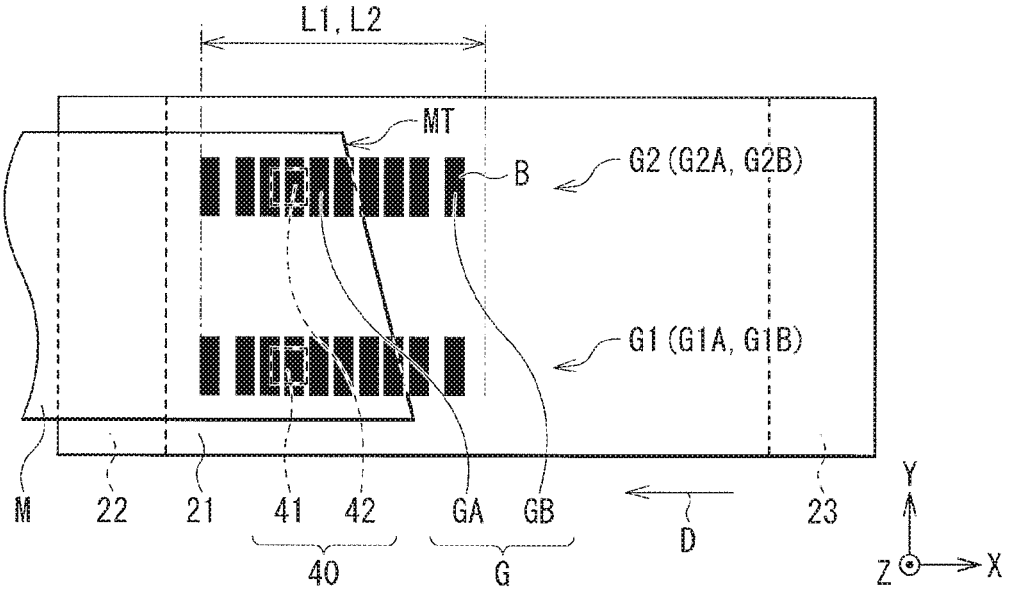
FIG. 14 is a plan view for describing a configuration of the toner image according to a seventh configuration example.

FIGS. 13 and 14 each illustrate an example embodiment in which the toner image G has, as the pattern shape, a rectangular solid pattern that extends intermittently in the conveyance direction D. For example, the toner images G in the respective example embodiments illustrated in FIGS. 13 and 14 each may have a plurality of boxes B that are so arrayed as to be separated away from each other in the conveyance direction D. In the example embodiment illustrated in FIG. 13, a distance or an interval between the two mutually-adjacent boxes B may be fixed in the plurality of boxes B, whereas, in the example embodiment illustrated in FIG. 14, the distance or the interval between the two mutually-adjacent boxes B may be varied in the plurality of boxes B. For example, the intervals positioned upstream and downstream in the conveyance direction D may be made relatively larger, and the plurality of intervals positioned in the middle between the relatively larger intervals may be made smaller.

[1.4 Principle of Controlling Conveying Speed and Cutting Speed]

A description is given next of an example of a principle of controlling the conveying speed and the cutting speed performed by the image forming apparatus, e.g., performed by the image forming controller 61.

In the following, one principle of controlling the conveying speed and the cutting speed according to an example embodiment will be described by referring to a non-limiting example where; the number of image detection sensors 40 is two, i.e., the image detection sensors 40 include the image detection sensors 41 and 42; the number of toner images G is two, i.e., the toner images G include the toner images G1 and G2; the toner image G has the continuous solid pattern as its configuration as illustrated in FIGS. 6 to 8; and the cutter 204 includes the rotatable rotary cutter.

Figure 15:
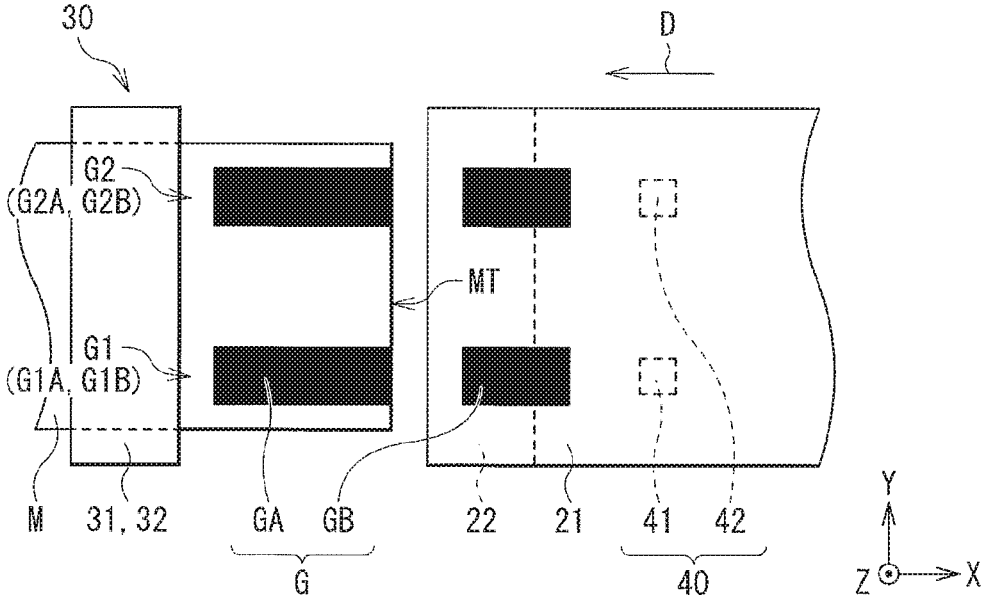
FIG. 15 is a plan view for describing an example of one principle of controlling a conveying speed and a cutting speed.
Figure 16:
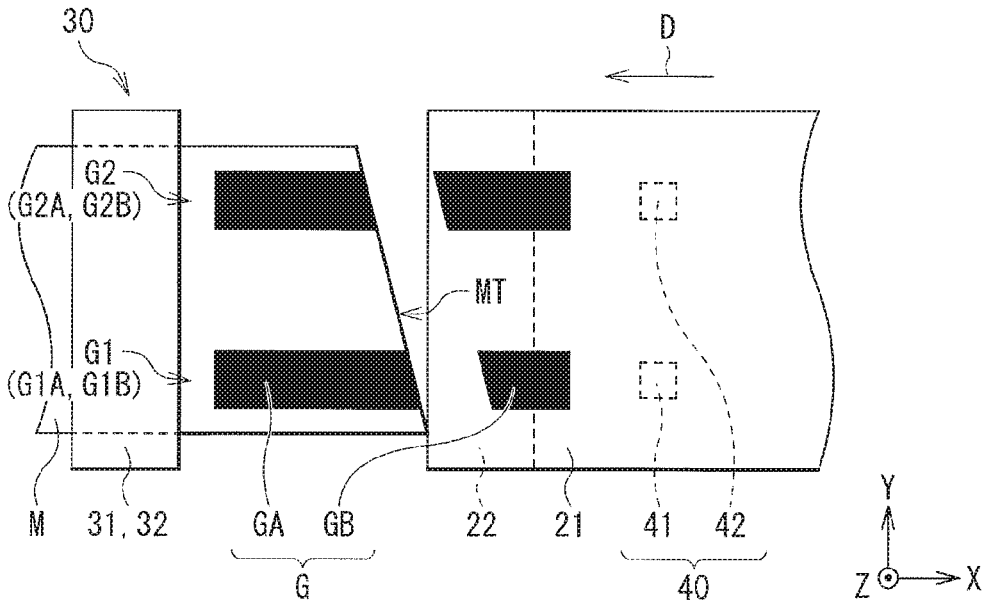
FIG. 16 is another plan view for describing one example of the principle of controlling the conveying speed and the cutting speed.
Figure 17:
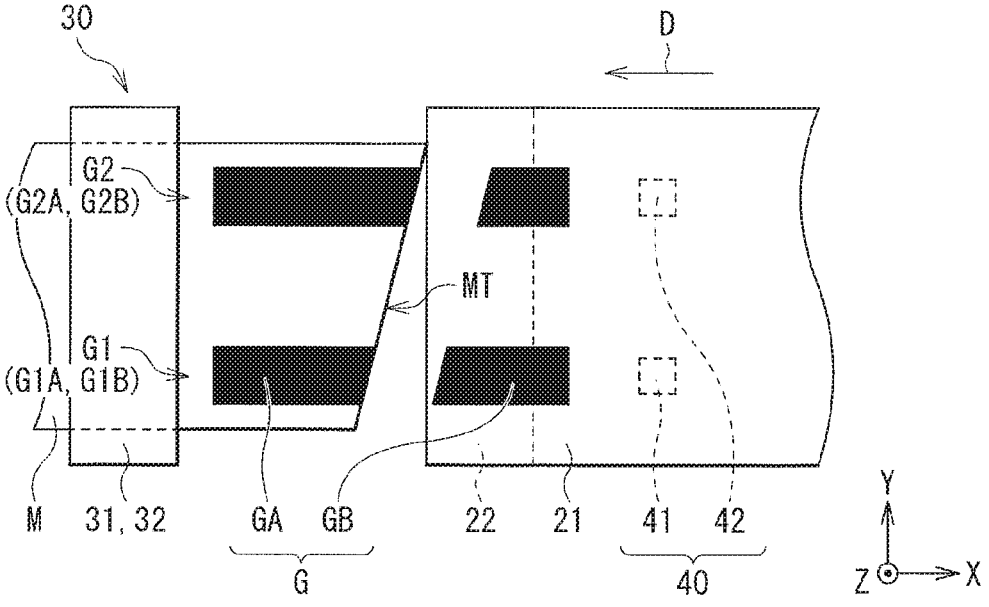
FIG. 17 is yet another plan view for describing the example of one principle of controlling the conveying speed and the cutting speed.

FIGS. 15 to 17 illustrate plan configurations corresponding to the respective configurations illustrated in FIGS. 6 to 8 for describing one example of the principle of controlling the conveying speed and the cutting speed. Note that FIGS. 15 to 17 each illustrate a state in which the print medium M has been conveyed more in the conveyance direction D than that in the example case illustrated in each of FIGS. 6 to 8, and each illustrate the fixing section 30 including the heating roller 31 and the pressure applying roller 32 as well.

Figure 18:
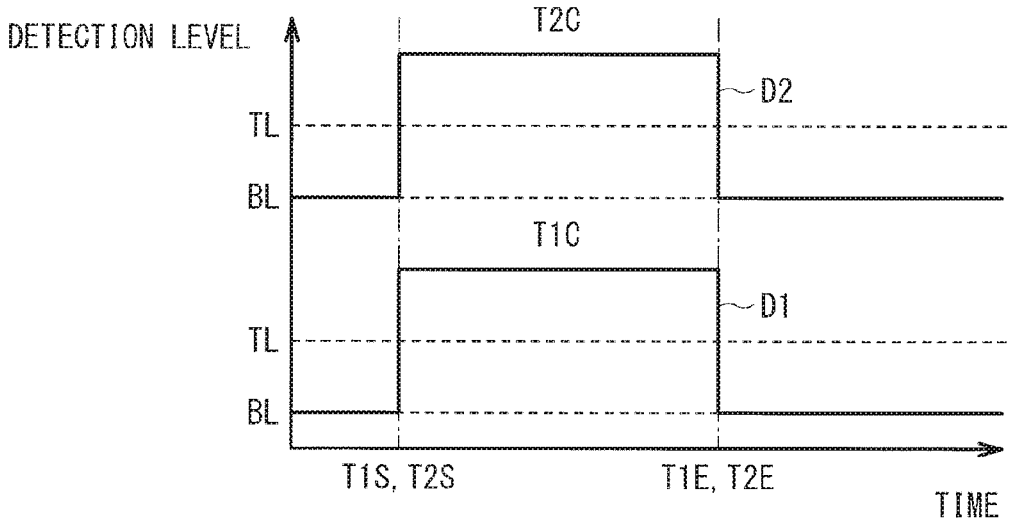
FIG. 18 is a diagram illustrating an example of detection results obtained by image detection sensors.
Figure 19:
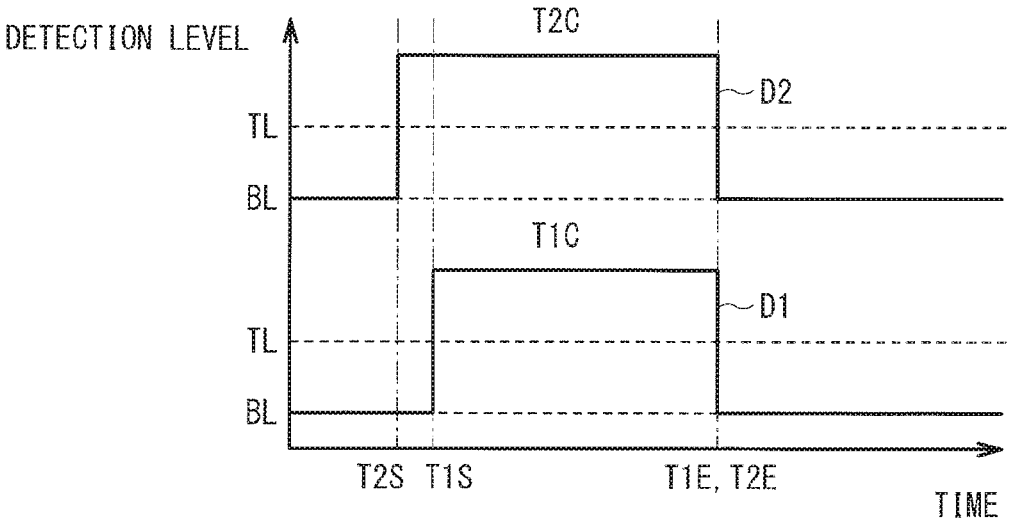
FIG. 19 is a diagram illustrating another example of the detection results obtained by the image detection sensors.

FIGS. 18 and 19 each illustrate an example of detection results obtained by the image detection sensors 41 and 42. FIG. 18 illustrates the detection result corresponding to the example case illustrated in FIG. 15, and FIG. 19 illustrates the detection result corresponding to the example case illustrated in FIG. 16.

FIGS. 18 and 19 each also illustrate a detection result D1 obtained by the image detection sensor 41, a detection result D2 obtained by the image detection sensor 42, a base value BL, and a detection threshold TL. The base value BL is a value of a detection level obtained where the image detection sensor 41 or 42 does not detect the corresponding conveyance toner image G1B or G2B. The detection threshold TL is a value of the detection level (i.e., a threshold) serving as a reference used for discriminating between presence and absence of the detection of the conveyance toner image G1B or G2B.

As described previously, after the toner images G1 and G2 (e.g., the medium toner image GA and the conveyance toner image GB) are formed, the image forming controller 61 may vary one or both of the conveying speed and the cutting speed on the basis of the detection results related to the conveyance toner images G1B and G2B obtained by the image detection sensors 41 and 42, for example.

For example, the rolled print medium M may be cut by the cutter 204 in the medium feeding unit 200 as illustrated in FIG. 2, following which the print medium M thus having the cut edge MT may be fed to the image forming unit 100 as illustrated in FIGS. 6 to 8.

The rolled print medium M may be cut by the cutter 204 upon the conveyance by the conveying rollers 202 and 203. Accordingly, a cut state of the print medium M by the cutter 204 may possibly vary depending on a relationship between the conveyance speed of the print medium M to be conveyed by the conveying rollers 202 and 203 and the cutting speed of the print medium M to be cut by the cutter 204, meaning that an extending direction of the cut edge MT may possibly vary as well. The cutting speed may correspond to a rotation speed of the cutter 204, e.g., the rotation speed of the rotary cutter.

For example, the relationship between the conveying speed and the cutting speed may be appropriate in a case where the conveying speed and the cutting speed are substantially coincident with each other. In this case, the print medium M may be cut in such a manner that the extending direction of the cut edge MT follows along the width direction as illustrated by way of example in FIG. 6 and the print medium M may be thus cut normally.

In contrast, the relationship between the conveying speed and the cutting speed may be inappropriate in a case where a mismatch occurs between the conveying speed and the cutting speed. In this case, the print medium M may be cut in such a manner that the extending direction of the cut edge MT becomes oblique relative to the width direction as illustrated by way of example in FIGS. 7 and 8 and the print medium M may be thus not cut normally. Such improper cutting of the print medium M not only affects a quality of external appearance (e.g., presentation) of the print medium M but also possibly affects a formation accuracy of an image, such as an accuracy of transferring the toner T onto the print medium M. Accordingly, the print medium M not having been cut normally is undesirable in terms of stably forming an image on a surface of the print medium M.

After the toner images G1 and G2, e.g., the medium toner image GA and the conveyance toner image GB, are formed on the surface of the print medium M and the surface of the conveyance belt 21 as illustrated in FIGS. 6 to 8, the print medium M may be further conveyed in the conveyance direction D by the conveyance belt 21. Hence, the print medium M, having been formed with the medium toner images G1A and G2A, may be separated from the conveyance belt 21 having been formed with the conveyance toner images G1B and G2B, following which the print medium M may be further conveyed in the conveyance direction D to thereby enter the fixing section 30, i.e., enter the heating roller 31 and the pressure applying roller 32, as illustrated in FIGS. 15 to 17.

The conveyance belt 21 having been formed with the conveyance toner images G1B and G2B, on the other hand, may be caused to travel further after the print medium M, having been formed with the medium toner images G1A and G2A, are separated from the conveyance belt 21. As a result, the conveyance toner images G1B and G2B may pass through regions detectable by the respective image detection sensors 41 and 42, allowing the image detection sensors 41 and 42 to respectively detect the conveyance toner images G1B and G2B.

The image forming controller 61 may be based on one of the following two non-limiting control principles to vary one or both of the conveying speed and the cutting speed on the basis of the detection results obtained by the respective image detection sensors 41 and 42.

[First Control Principle]

For example, in order to detect, at the two positions that are different from each other in the width direction, the positions of the respective conveyance toner images G1B and G2B on the basis of the conveyance toner images G1B and G2B, the image detection sensors 41 and 42 may detect, at the respective two positions, the timings at which the detections of the respective conveyance toner images G1B and G2B are started. When the timings at which the detections of the respective conveyance toner images G1B and G2B are started are detected, the image detection sensors 41 and 42 may output results of the respective detections to the image forming controller 61. When the detection results are received from the respective image detection sensors 41 and 42, the image forming controller 61 may compare the positions of the respective conveyance toner images G1B and G2B at the two positions. In other words, the image forming controller 61 may compare the timings at which the detections of the respective conveyance toner images G1B and G2B are started. Through performing the comparison, the image forming controller 61 may calculate a difference between the positions (e.g., the timings) of the respective conveyance toner images G1B and G2B. In other words, the image forming controller 61 may calculate a difference between the timing at which the detection of the conveyance toner image G1B is started and the timing at which the detection of the conveyance toner image G2B is started. Through performing the above example process, the image forming controller 61 may determine whether the extending direction of the cut edge MT is oblique relative to the width direction.

For example, as illustrated in FIGS. 18 and 19, the image detection sensor 41 may detect a time at which the detection of the conveyance toner image G1B is started (i.e., a detection starting time T1S), and the image detection sensor 42 may detect a time at which the detection of the conveyance toner image G2B is started (i.e., a detection starting time T2S).

Through the use of the detection starting time T1S and the detection starting time T2S, the image forming controller 61 may calculate a difference between the detection starting time T1S and the detection starting time T2S as the starting time difference ΔTS (e.g., ΔTS=T1S−T2S). The starting time difference ΔTS may serve as an index that indicates the mismatch (e.g., a difference in speed) between the conveying speed and the cutting speed.

The starting time difference ΔTS may be 0 (zero) as illustrated in FIG. 18 in a case where the print medium M is cut in such a manner that the extending direction of the cut edge MT follows along the width direction as illustrated by way of example in FIG. 15. The starting time difference ΔTS, however, may take a value other than 0 in a case where the print medium M is cut in such a manner that the extending direction of the cut edge MT becomes oblique relative to the width direction as illustrated by way of example in FIGS. 16 and 17. For example, the starting time difference ΔTS may take a negative value in each of the example cases illustrated in FIGS. 16 and 19, whereas the starting time difference ΔTS may take a positive value in the example case illustrated in FIG. 17. Thus, the image forming controller 61 may be able to determine whether the print medium M is cut in such a manner that the extending direction of the cut edge MT becomes oblique relative to the width direction on the basis of the value of the starting time difference ΔTS, e.g., on the basis of whether the value of the starting time difference ΔTS is 0.

The image forming controller 61 may determine that the print medium M is cut normally in the example case where the starting time difference ΔTS is 0, because in this case the print medium M is cut in such a manner that the extending direction of the cut edge MT follows along the width direction. Accordingly, the image forming controller 61 does not vary one or both of the conveying speed and the cutting speed.

The image forming controller 61 may determine that the print medium M is not cut normally in the example case where the starting time difference ΔTS takes the value other than 0 (e.g., the starting time difference ΔTS takes the negative value or the positive value), because in this case the print medium M is cut in such a manner that the extending direction of the cut edge MT becomes oblique relative to the width direction. Accordingly, the image forming controller 61 may vary one or both of the conveying speed and the cutting speed.

For example, the image forming controller 61 may so vary one or both of the conveying speed and the cutting speed as to cause the value of the starting time difference ΔTS to be closer to 0. In an example embodiment, the image forming controller 61 may vary the conveying speed through causing the roller driving controller 71 to vary a rotation speed of the roller motor 77. In an alternative example embodiment, the image forming controller 61 may vary the cutting speed through causing the cutter driving controller 76 to vary a rotation speed of the cutter motor 83. e.g., through varying the rotation speed of the rotary cutter. Thus, the image forming controller 61 may so adjust the cutting process of the print medium M as to cause the extending direction of the cut edge MT to follow along the width direction.

For example, in the example case illustrated in FIG. 16, the image forming controller 61 may increase the conveying speed because the conveying speed is relatively smaller than the cutting speed, or may decrease the cutting speed because the cutting speed is relatively larger than the conveying speed. In the example case illustrated in FIG. 17, the image forming controller 61 may decrease the conveying speed because the conveying speed is relatively larger than the cutting speed, or may increase the cutting speed because the cutting speed is relatively smaller than the conveying speed.

A level of decreasing the starting time difference ΔTS is not particularly limited. For example, a value of the starting time difference ΔTS after controlling one or both of the conveying speed and the cutting speed may be 0 or any value other than 0, as long as the starting time difference ΔTS after the control takes a value that is closer to 0 than an initial value of the starting time difference ΔTS, i.e., than the value of the starting time difference ΔTS that is prior to the control of one or both of the conveying speed and the cutting speed.

[Second Control Principle]

For example, the image detection sensors 41 and 42 may detect, at the respective two positions that are different from each other in the width direction, the lengths of the respective conveyance toner images G1B and G2B on the basis of the conveyance toner images G1B and G2B. When the lengths of the respective conveyance toner images G1B and G2B are detected, the image detection sensors 41 and 42 may output results of the respective detections to the image forming controller 61. When the detection results are received from the respective image detection sensors 41 and 42, the image forming controller 61 may compare the lengths of the respective conveyance toner images G1B and G2B at the two positions. Through performing the comparison, the image forming controller 61 may calculate a difference between the lengths of the respective conveyance toner images G1B and G2B. In other words, the image forming controller 61 may calculate a difference between the length of the conveyance toner image G1B and the length of the conveyance toner image G2B. Through performing the above example process, the image forming controller 61 may determine whether the extending direction of the cut edge MT is oblique relative to the width direction.

For example, as illustrated in FIGS. 18 and 19, the image detection sensor 41 may detect the time at which the detection of the conveyance toner image G1B is started (i.e., the detection starting time T1S) and a time at which the detection of the conveyance toner image G1B is ended (i.e., a detection ending time T1E). Further, for example, the image detection sensor 42 may detect the time at which the detection of the conveyance toner image G2B is started (i.e., the detection starting time T2S) and a time at which the detection of the conveyance toner image G2B is ended (i.e., a detection ending time T2E).

Through the use of the detection starting time T1S, the detection ending time T1E, the detection starting time T2S, and the detection ending time T2E, the image forming controller 61 may calculate a detection time T1C and a detection time T2C. The detection time T1C may be used to identify the length of the conveyance toner image G1B, and may be defined as a resultant of subtraction of the detection starting time T1S from the detection ending time T1E (i.e., T1C=T1E−T1S). The detection time T2C may be used to identify the length of the conveyance toner image G2B, and may be defined as a resultant of subtraction of the detection starting time T2S from the detection ending time T2E (T2C=T2E−T2S). After calculating the detection time T1C and the detection time T2C, the image forming controller 61 may calculate a difference between the detection time T1C and the detection time T2C as the detection time difference ΔTC (e.g., ΔTC=T1C−T2C). The detection time difference ΔTC may serve as another index that indicates the mismatch (e.g., a difference in speed) between the conveying speed and the cutting speed.

The detection time difference ΔTC may be 0 (zero) as illustrated in FIG. 18 in a case where the print medium M is cut in such a manner that the extending direction of the cut edge MT follows along the width direction as illustrated by way of example in FIG. 15. The detection time difference ΔTC, however, may take a value other than 0 in a case where the print medium M is cut in such a manner that the extending direction of the cut edge MT becomes oblique relative to the width direction as illustrated by way of example in FIGS. 16 and 17. For example, the detection time difference ΔTC may take a negative value in each of the example cases illustrated in FIGS. 16 and 19, whereas the detection time difference ΔTC may take a positive value in the example case illustrated in FIG. 17. Thus, the image forming controller 61 may be able to determine whether the print medium M is cut in such a manner that the extending direction of the cut edge MT becomes oblique relative to the width direction on the basis of the value of the detection time difference ΔTC, e.g., on the basis of whether the value of the detection time difference ΔTC is 0.

The image forming controller 61 may determine that the print medium M is cut normally in the example case where the detection time difference ΔTC is 0 and does not vary one or both of the conveying speed and the cutting speed accordingly, as with the example case where the starting time difference ΔTS is 0. The image forming controller 61 may determine that the print medium M is not cut normally in the example case where the detection time difference ΔTC take the value other than 0 (e.g., the detection time difference ΔTC take the negative value or the positive value) and may vary one or both of the conveying speed and the cutting speed accordingly, as with the example case where the starting time difference ΔTS takes the value other than 0. Note that a method of controlling one or both of the conveying speed and the cutting speed to be performed here is as described in detail above. It is to be also noted that a level of decreasing the detection time difference ΔTC may be the same or similar to what has been described in detail above with respect to the level of decreasing the starting time difference ΔTS.

In an example embodiment, the image forming controller 61 may select to vary the conveying speed instead of selecting to vary the cutting speed in each of the first and the second control principles. One reason is that this readily improves an accuracy of varying the speed and thereby makes it easier to adjust the cutting operation of the print medium M such that the extending direction of the cut edge MT follows along the width direction.

More specifically, the cutter 204 may be directly coupled to the cutter motor 83 and hence the cutting speed, determined in accordance with a rotation operation of the cutter motor 83, is less susceptible to a change in kind of the print medium M, in an environmental condition, or in any other factor. In contrast, the conveying rollers 202 and 203 come into contact with the print medium M upon the conveyance and hence the conveying speed, determined in accordance with a rotation operation of each of the conveying rollers 202 and 203, is more susceptible to the change in kind of the print medium M, in the environmental condition, or in any other factor. Accordingly, varying the conveying speed (which is more susceptible to kind of the print medium M, the environmental condition, etc.) while using the cutting speed (which is less susceptible to kind of the print medium, the environmental condition, etc.) as a reference makes it possible to adjust, easily and with high accuracy, the cutting operation of the print medium M such that the extending direction of the cut edge MT follows along the width direction. For example, the image forming controller 61 may vary the conveying speed while setting the cutting speed to be constant.

[1-5. Operation]

A description is given below of an example operation of the image forming apparatus, in which an example of a formation process of an image is described first followed by an example of an adjustment operation of the cutting process. In the following description, a reference is made to the foregoing FIGS. 1 to 8 and 15 to 17 as necessary.

[Formation Operation of Image]

Upon forming an image on the print medium M, the image forming apparatus may perform a developing process, a transfer process, and a fixing process in this order as will be described below, for example. Further, the image forming apparatus may perform a cleaning process on an as-needed basis. For example, such a series of processes may be controlled by the control board 60, e.g., by the image forming controller 61.

[Developing Process]

The medium feeding unit 200 may cut the rolled print medium M by the cutter 204 while conveying the rolled print medium M by the conveying rollers 202 and 203. Thereafter, the medium feeding unit 200 may feed the print medium M cut by the cutter 204 to the image forming unit 100.

Upon the developing process in the developing unit 10 (e.g., in the developing process unit 11), the charging roller 113 may apply a direct-current voltage to the surface of the photosensitive drum 112 while rotating in accordance with the rotation of the photosensitive drum 112. The surface of the photosensitive drum 112 may be thereby electrically charged evenly. Thereafter, the light source 13 may apply light to the surface of the photosensitive drum 112 on the basis of image data. A surface potential in a region, of the surface of the photosensitive drum 112, on which the light is applied is thereby attenuated. In other words, optical attenuation occurs. An electrostatic latent image may be thus formed on the surface of the photosensitive drum 112. It is to be noted that the image data described above may be supplied to the image forming apparatus from the external apparatus such as a personal computer, for example.

In the developing process unit 11, the feeding roller 114 and the developing roller 115 may rotate when receiving application of the voltage. The toner T may be thereby fed from the feeding roller 114 to the developing roller 115. Further, the toner T may move from the developing roller 115 to the photosensitive drum 112 upon the rotation of the photosensitive drum 112. The toner T may be thereby attached to the photosensitive drum 112, i.e., to the electrostatic latent image. In this case, the toner T attached to the developing roller 115 may be partially removed by the developing blade 116, whereby the toner T attached to the developing roller 115 may be caused to have an even thickness.

Further, the toner T may be stirred in the developing unit 10 (e.g., in the toner cartridge 12) to thereby feed the toner T from the toner cartridge 12 to the developing process unit 11.

[Transfer Process]

When the driving roller 22 rotates in the transfer section 20, the driven roller 23 may rotate in accordance with the rotation of the driving roller 22. This may cause the conveyance belt 21 to travel. In the transfer process, the transfer roller 24 may be so pressed against the photosensitive drum 112 as to be in contact with the photosensitive drum 112 with the conveyance belt 21 in between. Hence, the toner T that has been attached to the photosensitive drum 112 in the foregoing developing process may be transferred onto the print medium M upon application of the voltage to the transfer roller 24.

[Fixing Process]

In the fixing process, the print medium M may be so conveyed as to pass through a region between the heating roller 31 and the pressure applying roller 32 in the fixing section 30. The toner T that has been transferred onto the print medium M may be thereby heated, which may cause the toner T to melt. Further, the molten toner T may be so pressed against the print medium M while being applied with a pressure. This may cause the toner T to be so attached to the print medium M as to be in close contact with the print medium M.

As a result, the toner T may be fixed to the print medium M, resulting in formation of an image on the print medium M. The print medium M thus formed with the image may be discharged from the discharge opening 110H. Incidentally, the kind of toner T and the number of toners T to be used for formation of an image may be determined on the basis of a combination of colors necessary for the formation of such an image.

[Cleaning Process]

In the developing unit 10, the photosensitive drum 112 may rotate while being so pressed against the cleaning blade 117 as to be in contact with the cleaning blade 117. This may cause an extraneous material such as the unnecessary remains of the toner T present on the surface of the photosensitive drum 112 to be scraped off by the cleaning blade 117. As a result, the extraneous material may be removed from the surface of the photosensitive drum 112.

Further, in the transfer section 20, the cleaning blade 25 may scrape off an extraneous material such as the unnecessary remains of the toner T present on the surface of the conveyance belt 21 upon traveling of the conveyance belt 21. As a result, unnecessary remains of the toner T may be removed from the surface of the conveyance belt 21 and may be collected by the collection box 26.

[Adjustment Operation of Cutting Process]

The image forming apparatus, i.e., the image forming controller 61, may perform the adjustment operation of the cutting process at any timing as described below, on the basis of any of the foregoing first and second principles of controlling the conveying speed and the cutting speed.

In an example embodiment, the timing at which the adjustment operation of the cutting process is performed may be made settable on an as-necessary basis, as long as the timing is other than a timing at which the formation of the print medium M is carried out in accordance with the use of the image forming apparatus by the user, i.e., other than a timing upon the regular use of the image forming apparatus. For example, the timing at which the adjustment operation of the cutting process is performed may be a timing at which a predetermined time is elapsed from the initial use of the image forming apparatus, or may be a timing at which the predetermined number of image formation times is performed from the initial use of the image forming apparatus.

Figure 20:
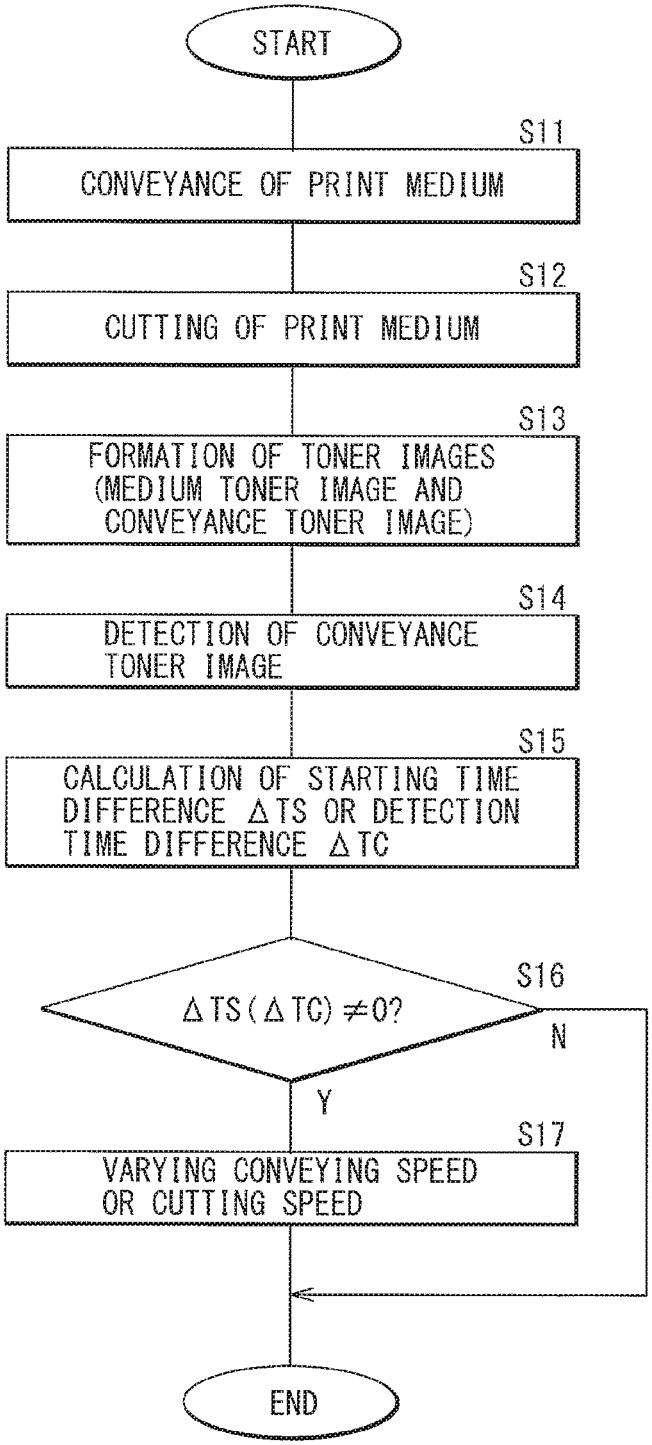
FIG. 20 is a flowchart illustrating an example of a flow of an adjustment operation of a cutting process.

FIG. 20 illustrates an example of a flow of the adjustment operation of the cutting process for describing the example adjustment operation of the cutting process. Note that step numbers in parentheses described below correspond to those illustrated in FIG. 20.

[Conveyance of Print Medium]

Upon performing the adjustment operation of the cutting process, the image forming controller 61 may first cause the roller driving controller 71 (i.e., may first use the roller motors 77) to rotate the conveying rollers 202 and 203 to thereby convey the rolled print medium M in the conveyance direction D along the conveyance route P at any timing described above (step S11). Thus, the rolled print medium M may be fed to the cutter 204.

[Cutting of Print Medium]

Thereafter, the image forming controller 61 may cause the cutter driving controller 76 (i.e., may use the cutter motor 83) to operate the cutter 204 and may thereby cut the rolled print medium M (step S12). In an example embodiment where the cutter 204 includes the rotary cutter, the rotary cutter may cut the rolled print medium M upon its rotation. The print medium M thus cut by the cutter 204 may be continuously conveyed in the conveyance direction D along the conveyance route P by the conveying rollers 202 and 203 so as to be fed from the medium feeding unit 200 to the image forming unit 100. The print medium M may be further conveyed in the conveyance direction D along the conveyance route P by the conveyance belt 21 and the conveying rollers 51 and 52.

[Formation of Toner Images (Medium Toner Image and Conveyance Toner Image)]

Thereafter, the image forming controller 61 may cause, upon conveying the print medium M in the conveyance direction D, the toner T to be transferred onto the surface of the print medium M and the surface of the conveyance belt 21 through the use of the developing unit 10 and the transfer roller 24, and may thereby form the toner images G1 and G2, i.e., may thereby form the medium toner image GA and the conveyance toner image GB (step S13). The print medium M having been formed with the toner images G1 and G2 may be further conveyed in the conveyance direction D so that the conveyance belt 21 having been formed with the conveyance toner images G1B and G2B is separated from the print medium M having been formed with the medium toner images G1A and G2A. The print medium M having been formed with the medium toner images G1A and G2A may enter the fixing section 30, whereas the conveyance belt 21 having been formed with the conveyance toner images G1B and G2B may be caused to further travel in accordance with the rotation of each of the driving roller 22 and the driven roller 23.

[Detection of Conveyance Toner Images]

Thereafter, the image forming controller 61 may cause the sensor driving controller 75 to operate the image detection sensors 41 and 42 and thereby detect the conveyance toner images G1B and G2B formed on the surface of the conveyance belt 21 (step S14). The detection results obtained by the respective image detection sensors 41 and 42 may include the detection starting times T1S and T2S and the detection ending times T1E and T2E as described above, and may be supplied to the image forming controller 61.

[Calculation of Starting Time Difference]

Thereafter, the image forming controller 61 may calculate the starting time difference ΔTS on the basis of the detection results obtained by the respective image detection sensors 41 and 42, e.g., on the basis of the comparison between the conveyance toner images G1B and G2B respectively detected by the image detection sensors 41 and 42 at the two positions that are different from each other in the width direction (step S15). A non-limiting example of a procedure for calculating the starting time difference ΔTS is as described above.

[Determination on Starting Time Difference]

Thereafter, the image forming controller 61 may determine, on the basis of a result of the calculation of the starting time difference ΔTS, whether the starting time difference ΔTS takes a value other than 0 (step S16).

In a case where the starting time difference ΔTS is 0 (step S16: N), the image forming controller 61 may determine that the print medium M has been cut normally, because the print medium M has been cut in such a manner that the extending direction of the cut edge MT follows along the width direction. In this case, the image forming controller 61 may end the adjustment operation of the cutting process, because it is not necessary to perform the adjustment operation of the cutting process.

[Varying Conveying Speed]

In a case where the starting time difference ΔTS takes the value other than 0 (step S16: Y), the image forming controller 61 may determine that the print medium M has not been cut normally, because the print medium M has been cut in such a manner that the extending direction of the cut edge MT becomes oblique relative to the width direction. In this case, the image forming controller 61 may perform the adjustment operation of the cutting process, because it is necessary to perform the adjustment operation of the cutting process. For example, the image forming controller 61 may so vary the conveying speed through the use of the roller driving controller 71, i.e., the roller motors 77, as to cause the value of the starting time difference ΔTS to be closer to 0 (step S17). A non-limiting example of a procedure for varying the conveying speed is as described above. Thus, the conveying speed may be made appropriate with respect to the cutting speed, allowing the print medium M to be cut in such a manner that the extending direction of the cut edge MT follows along the width direction when the rolled print medium M is to be cut by the cutter 204 next time and after, and thereby completing the adjustment operation of the cutting process.

For example, the toner T having been transferred onto the surface of the conveyance belt 21 for the formation of the conveyance toner image GB may be scraped off by the cleaning blade 25 as a result of further traveling of the conveyance belt 21. Thus, the toner T may be removed from the surface of the conveyance belt 21 and may be collected by the collection box 26.

[Calculation of Detection Time Difference. Determination on Detection Time Difference, and Varying Conveying Speed]

Upon performing the adjustment operation of the cutting process, the image forming controller 61 may calculate the detection time difference ΔTC on the basis of the detection results obtained by the respective image detection sensors 41 and 42 (step S15) instead of calculating the starting time difference ΔTS. Through calculating the detection time difference ΔTC instead of the starting time difference ΔTS, the image forming controller 61 may determine whether the detection time difference ΔTC takes a value other than 0 (step S16). A non-limiting example of a procedure for calculating the detection time difference ΔTC is as described above. Accordingly, the image forming controller 61 may end the adjustment operation of the cutting process in a case where the detection time difference ΔTC is 0 (step S16; N), and may so vary the conveying speed as to cause the value of the detection time difference ΔTC to be closer to 0 (step S17) in a case where the detection time difference ΔTC takes the value other than 0 (step S16: Y). Here, in an alternative example embodiment, the image forming controller 61 may use both of the starting time difference ΔTS and the detection time difference ΔTC upon performing the adjustment operation of the cutting process.

[Varying Cutting Speed]

The image forming controller 61 may vary the cutting speed (step S17) instead of varying the conveying speed upon performing the adjustment operation of the cutting process. A non-limiting example of a procedure for varying the cutting speed is as described above. Here, in an alternative example embodiment, the image forming controller 61 may vary both of the conveying speed and the cutting speed upon performing the adjustment operation of the cutting process.

[1-6. Example Workings and Example Effects]

In the image forming apparatus according to an example embodiment, the conveying rollers 202 and 203 conveys the print medium M, and the cutter 204 cuts the print medium M. Further, the developing unit 10 and the transfer roller 24 form the toner image G, e.g., the medium toner image GA and the conveyance toner image GB, on the print medium M and the conveyance belt 21. Thereafter, the image detection sensors 40 detects, at the two positions, the conveyance toner image GB, and the image forming controller 61 varies one or both of the conveying speed and the cutting speed on the basis of the comparison of the conveyance toner image GB detected at the two positions by the image detection sensors 40.

In such an example embodiment, a determination may be made, on the basis of the detection results obtained by the image detection sensors 40, as to whether the print medium M is cut in such a manner that the extending direction of the cut edge MT becomes oblique relative to the width direction. In a case where the print medium M has been cut in such a manner that the extending direction of the cut edge MT becomes oblique relative to the width direction, one or both of the conveying speed and the cutting speed may be varied to thereby adjust the cutting process of the print medium M such that the extending direction of the cut edge MT follows along the width direction. This configuration makes it easier to cut the print medium M by the cutter 204 in such a manner that the extending direction of the cut edge MT follows along the width direction and thereby makes it easier to cut the print medium M normally. Hence, it is possible to stably forms an image on the print medium M.

In addition, in an example embodiment, the image detection sensors 40 may detect, at the two positions, the position of the conveyance toner image GB, and the image forming controller 61 may vary one or both of the conveying speed and the cutting speed on the basis of the comparison between the positions of the conveyance toner image GB detected at the two positions. Such an example embodiment makes it easier to cut the print medium M such that the extending direction of the cut edge MT follows along the width direction. Further, in an example embodiment, the image detection sensors 40 may detect the detection starting time (e.g., the detection starting time T1S and the detection starting time T2S) at the two positions on the basis of the conveyance toner image GB, and the image forming controller 61 may calculate the starting time difference ΔTS and may so vary one or both of the conveying speed and the cutting speed as to cause the value of the starting time difference ΔTS to be closer to 0. This configuration makes it easier to cut, stably and with high accuracy, the print medium M in such a manner that the extending direction of the cut edge MT follows along the width direction, and thereby makes it easier to adjust the cutting process of the print medium M. Hence, it is possible to achieve higher effects.

Alternatively, in an example embodiment, the image detection sensors 40 may detect, at the two positions, the lengths of the conveyance toner image GB, and the image forming controller 61 may vary one or both of the conveying speed and the cutting speed on the basis of the comparison between the lengths of the conveyance toner image GB detected at the two positions. Such an example embodiment makes it easier to cut the print medium M such that the extending direction of the cut edge MT follows along the width direction. Further, in an example embodiment, the image detection sensors 40 may detect the detection starting time (e.g., the detection starting time T1S and the detection starting time T2S) at the two positions and the detection ending time (e.g., the detection ending time T1E and the detection ending time T2E) at the two positions on the basis of the conveyance toner image GB, and the image forming controller 61 may calculate the detection time difference ΔTC and may so vary one or both of the conveying speed and the cutting speed as to cause the value of the detection time difference ΔTC to be closer to 0. This configuration makes it easier to cut, stably and with high accuracy, the print medium M in such a manner that the extending direction of the cut edge MT follows along the width direction, and thereby makes it easier to adjust the cutting process of the print medium M. Hence, it is possible to achieve higher effects.

In any of such example embodiments, the image forming controller 61 may vary the conveying speed. This configuration readily improves an accuracy of varying the speed and thereby makes it easier to adjust the cutting operation of the print medium M such that the extending direction of the cut edge MT follows along the width direction. Hence, it is possible to achieve higher effects.

In any of such example embodiments, the cutter 204 may include the rotary cutter that is rotatable and cut the print medium M upon the conveyance of the print medium M, and the image forming controller 61 may vary the cutting speed on the basis of the rotation speed of the rotary cutter. This configuration makes it easier to vary the cutting speed in accordance with the rotation speed of the rotary cutter. Hence, it is possible to achieve higher effects.

In any of such example embodiments, the developing unit 10 and the transfer roller 24 may form the two toner images G (e.g., the toner images G1 and G2) that are disposed away from each other in the width direction, and the two image detection sensors 40 (the image detection sensors 41 and 42) disposed away from each other in the width direction may be used to detect the respective toner images G1 and G2. This configuration makes it easier to cut, on the basis of the starting time difference ΔTS or the detection time difference ΔTC, the print medium M in such a manner that the extending direction of the cut edge MT follows along the width direction, and thereby makes it easier to adjust the cutting process of the print medium M. Hence, it is possible to achieve higher effects.

In any of such example embodiments, the toner image G may extend, in the conveyance direction D, continuously from the surface of the print medium M through the cut edge MT to the surface of the conveyance belt 21. This configuration makes it easier to calculate the starting time difference ΔTS or the detection time difference ΔTC on the basis of the toner image G that extends continuously and thereby to cut the print medium M in such a manner that the extending direction of the cut edge MT follows along the width direction, which in turn makes it easier to adjust the cutting process of the print medium M. Hence, it is possible to achieve higher effects. Note that the example workings and the example effects described above are obtainable as well in any embodiment where the toner image G extends intermittently from the surface of the print medium M through the cut edge MT to the surface of the conveyance belt 21 in the conveyance direction D.

2. IMAGE FORMING APPARATUS (SECOND EXAMPLE EMBODIMENT)

A description is given below of an image forming apparatus according to a second example embodiment of the technology.

[2-1. Configuration]

Figure 21:
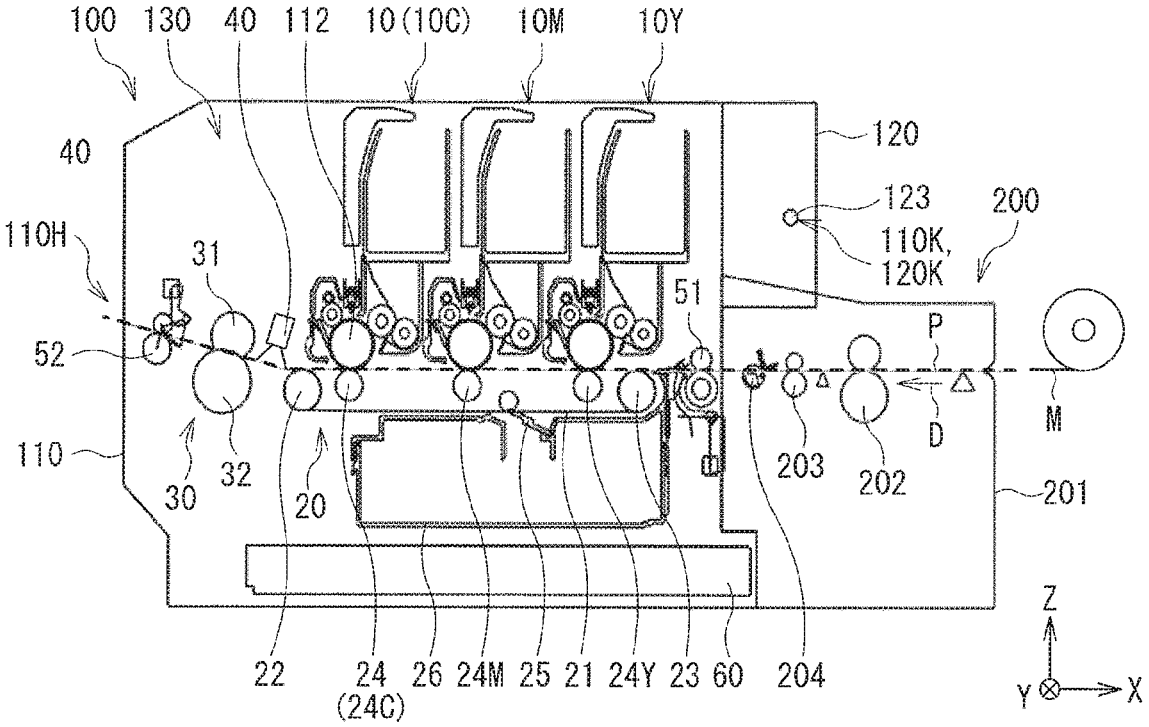
FIG. 21 is a schematic plan view of an example of a configuration of an image forming apparatus according to one embodiment of the technology.

FIG. 21 illustrates an example of a perspective configuration of the image forming apparatus according to the second example embodiment, and corresponds to FIG. 1. FIGS. 22 to 25 illustrate examples of plan configurations corresponding to those illustrated in FIGS. 7, 8, 16, and 17 for describing one example of the principle of controlling the conveying speed and the cutting speed. FIG. 26 illustrates an example of detection results obtained by the image detection sensors 41 and 42, and corresponds to FIG. 19.

The image forming apparatus according to the second example embodiment may have a configuration similar to the configuration of the image forming apparatus according to the first example embodiment, with the exception that targets to be detected by the image detection sensors 40 (the image detection sensors 41 and 42) are different from the targets to be detected in the first example embodiment and hence locations at which the image detection sensors 40 are disposed are different from the locations in the first example embodiment. For example, referring to FIG. 21, the image detection sensors 41 and 42 may detect the medium toner image GA (e.g., the medium toner images G1A and G2A) formed on the surface of the print medium M instead of detecting the conveyance toner image GB (e.g., the conveyance toner images G1B and G2B) formed on the surface of the conveyance belt 21. Further, in order to detect the medium toner image GA (e.g., the medium toner images G1A and G2A) formed on the surface of the print medium M, the image detection sensors 41 and 42 may be disposed above the conveyance route P in a region between the conveyance belt 21 and the fixing section 30, for example.

Further, the image forming apparatus may be based on any of the first and the second control principles in order to vary one or both of the conveying speed and the cutting speed. For example, the first and the second control principles may be similar to those of the first example embodiment, with the exception that the image detection sensors 41 and 42 detect the medium toner image GA (e.g., the medium toner images G1A and G2A) instead of the conveyance toner image GB (e.g., the conveyance toner images G1B and G2B) as illustrated in FIGS. 22 to 25. For example, the first and the second control principles may also differ from those of the first example embodiment in that the image forming controller 61 calculates, instead of the starting time difference ΔTS, the ending time difference ΔTE on the basis of the detection ending time T1E and the detection ending time T2E.

Figure 22:
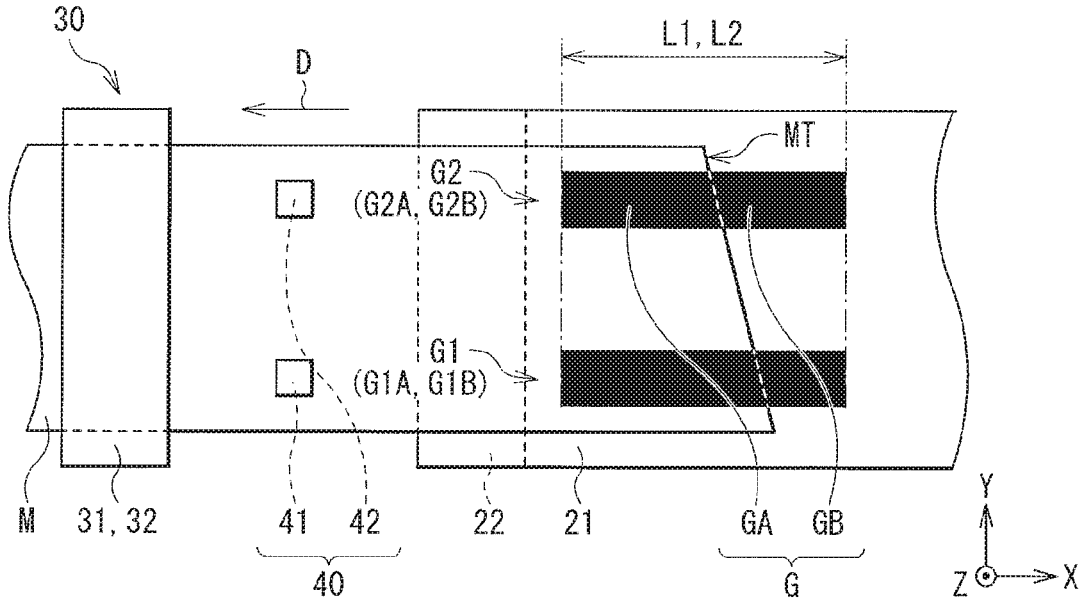
FIG. 22 is a plan view for describing an example of one principle of controlling the conveying speed and the cutting speed.
Figure 23:
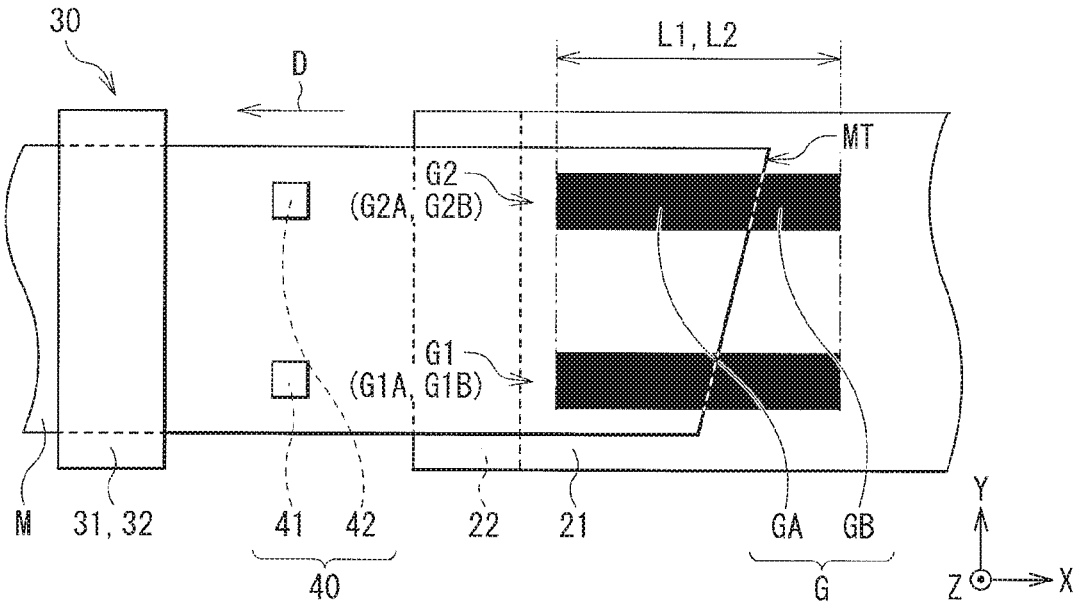
FIG. 23 is another plan view for describing one example of the principle of controlling the conveying speed and the cutting speed.
Figure 24:
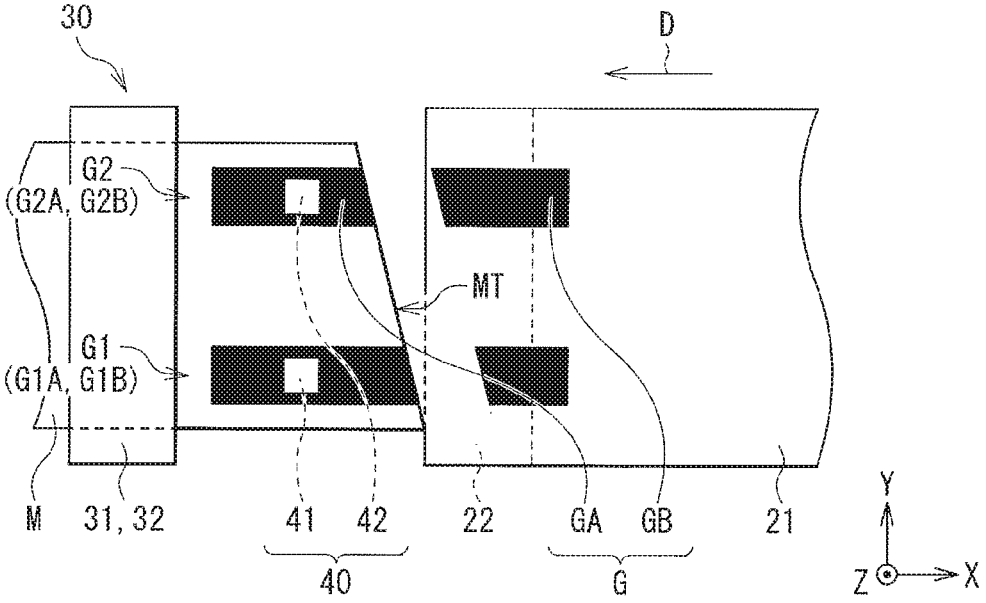
FIG. 24 is yet another plan view for describing one example of the principle of controlling the conveying speed and the cutting speed.
Figure 25:
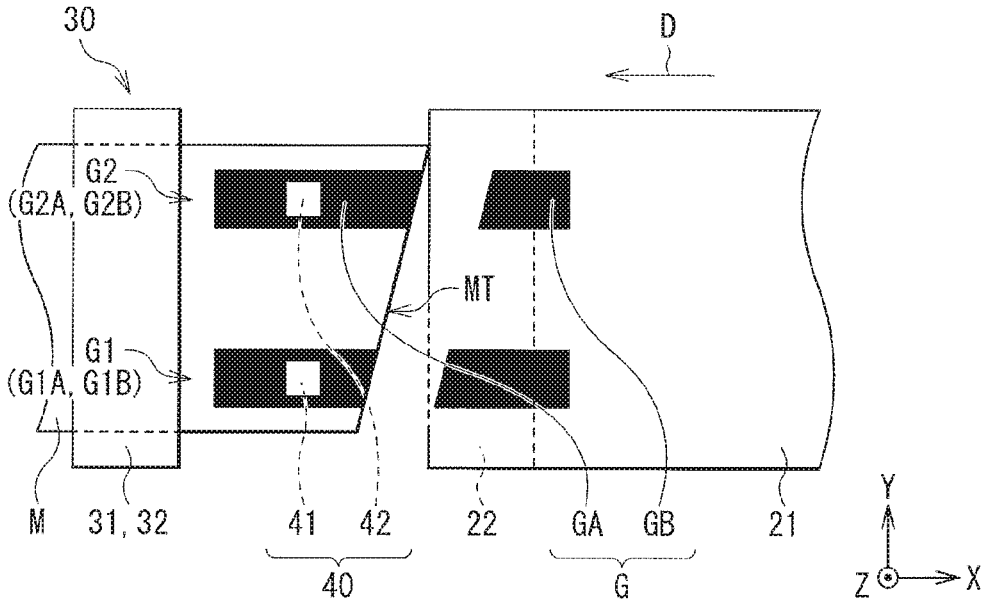
FIG. 25 is yet another plan view for describing one example of the principle of controlling the conveying speed and the cutting speed.
Figure 26:
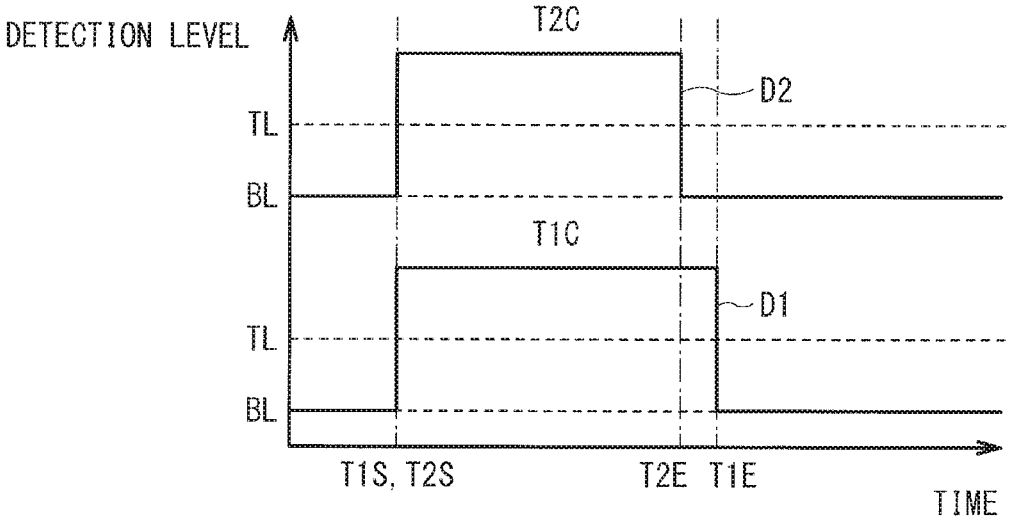
FIG. 26 is a diagram illustrating an example of the detection results obtained by the image detection sensors.

For example, after the toner image G, e.g., the toner images G1 and G2, are formed on the print medium M and the conveyance belt 21 as illustrated in FIGS. 22 and 23 and the print medium M is separated from the conveyance belt 21 as illustrated in FIGS. 24 and 25, the image forming controller 61 may vary one or both of the conveying speed and the cutting speed on the basis of the detection results related to the medium toner images G1A and G2A obtained by the image detection sensors 41 and 42.

In the first control principle, the image forming controller 61 may calculate the ending time difference ΔTE instead of the starting time difference ΔTS as described above. For example, the image detection sensors 41 and 42 may respectively detect the detection ending time T1E and the detection ending time T2E, in order to detect, at the two positions that are different from each other in the width direction, the positions of the respective medium toner images G1A and G2A as illustrated by way of example in FIG. 26. Thereafter, the image forming controller 61 may compare the positions of the respective medium toner images G1A and G2A at the two positions. In other words, the image forming controller 61 may compare the detection ending time T1E and the detection ending time T2E. Through performing the comparison, the image forming controller 61 may calculate a difference between the positions of the medium toner images G1A and G2A at the two positions. In other words, the image forming controller 61 may calculate a difference between the detection ending time T1E and the detection ending time T2E as the ending time difference ΔTE (e.g., ΔTE=T1E−T2E). The ending time difference ΔTE may be 0 (zero) in a case where the print medium M is cut in such a manner that the extending direction of the cut edge MT follows along the width direction. The ending time difference ΔTE, however, may take a value other than 0 in a case where the print medium M is cut in such a manner that the extending direction of the cut edge MT becomes oblique relative to the width direction as illustrated by way of example in FIGS. 24 to 26. Thus, the image forming controller 61 may be able to determine whether the print medium M is cut in such a manner that the extending direction of the cut edge MT becomes oblique relative to the width direction on the basis of the value of the ending time difference ΔTE, e.g., on the basis of whether the value of the ending time difference ΔTE is 0.

The image forming controller 61 may determine that the print medium M is cut normally in the example case where the ending time difference ΔTE is 0, because in this case the print medium M is cut in such a manner that the extending direction of the cut edge MT follows along the width direction. Accordingly, the image forming controller 61 does not vary one or both of the conveying speed and the cutting speed. The image forming controller 61 may determine that the print medium M is cut obliquely in the example case where the ending time difference ΔTE takes the value other than 0 (e.g., the ending time difference ΔTE takes the negative value or the positive value), because in this case the print medium M is cut in such a manner that the extending direction of the cut edge MT becomes oblique relative to the width direction. Accordingly, the image forming controller 61 may vary one or both of the conveying speed and the cutting speed.

For example, the image forming controller 61 may so vary one or both of the conveying speed and the cutting speed as to cause the value of the ending time difference ΔTE to be closer to 0. Note that a method of controlling one or both of the conveying speed and the cutting speed to be performed here is as described in detail in the first example embodiment. It is to be also noted that a level of decreasing the ending time difference ΔTE may be the same or similar to what has been described in detail in the first example embodiment with respect to the level of decreasing the starting time difference ΔTS.

In the second control principle, in order to detect, at the two positions that are different from each other in the width direction, the lengths of the respective medium toner images G1A and G2A as illustrated by way of example in FIG. 26, the image detection sensors 41 and 42 may respectively detect the detection starting times T1S and T2S as well as the detection ending times T1E and T2E on the basis of the medium toner images G1A and G2A, instead of detecting the detection starting times T1S and T2S and the detection ending times T1E and T2E on the basis of the conveyance toner images G1B and G2B. Thus, for example, the image forming controller 61 may calculate the detection time difference ΔTC on the basis of the detection results related to the medium toner images G1A and G2A instead of the detection results related to the conveyance toner images G1B and G2B. Further, for example, the image forming controller 61 may so vary, on the basis of the detection results that are based on the detection time difference ΔTC, one or both of the conveying speed and the cutting speed as to cause the value of the detection time difference ΔTC to be closer to 0.

[2-2. Operation]

Figure 27:
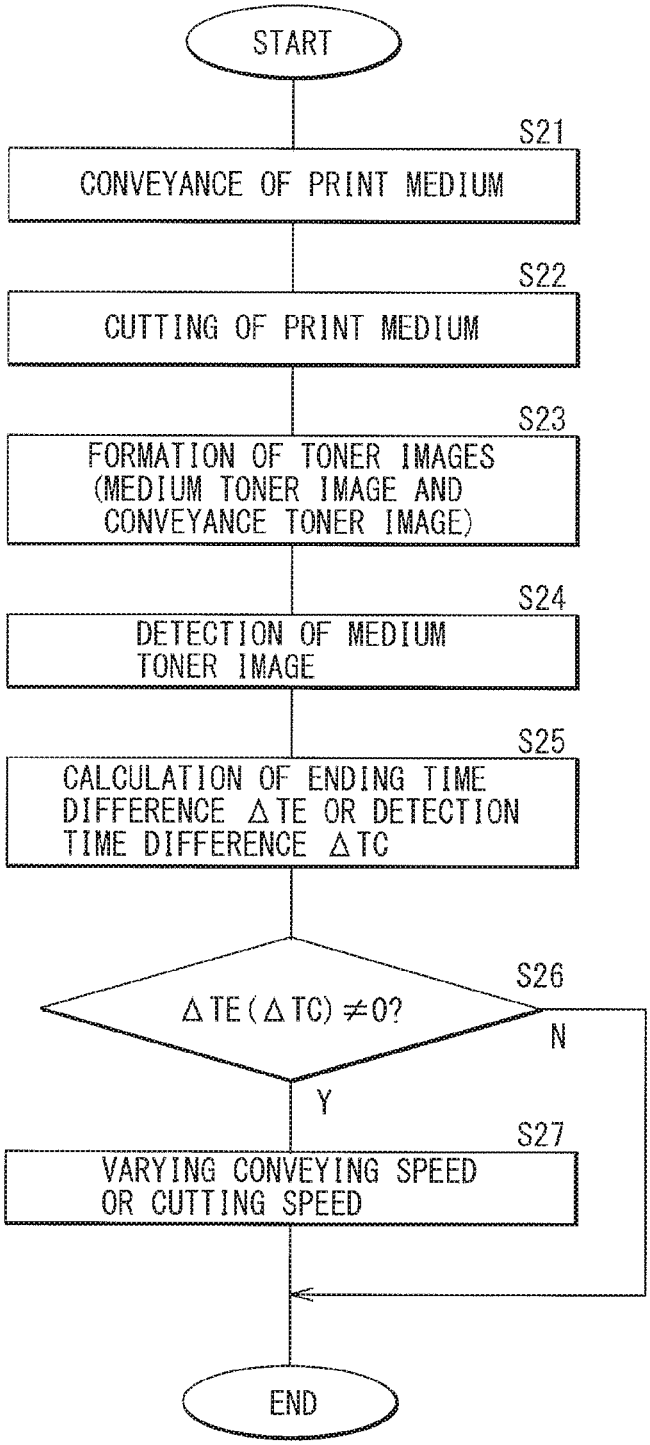
FIG. 27 is a flowchart illustrating an example of a flow of the adjustment operation of the cutting process.

FIG. 27 illustrates an example of a flow of the adjustment operation of the cutting process for describing the example adjustment operation of the cutting process. Note that step numbers in parentheses described below correspond to those illustrated in FIG. 27.

Operations of forming an image performed by the image forming apparatus according to the second example embodiment may be similar to the example operations to be performed by the image forming apparatus according to the first example embodiment. Further, the image forming apparatus according to the second example embodiment may perform the adjustment operation of the cutting process in accordance with an example procedure to be described below. In the following description, any operation similar to that performed in the first example embodiment will be described in a simplified fashion as necessary.

Upon performing the adjustment operation of the cutting process, the image forming controller 61 may first rotate the conveying rollers 202 and 203 to thereby convey the rolled print medium M in the conveyance direction D along the conveyance route P (step S21). During the conveyance of the rolled print medium M, the image forming controller 61 may operate the cutter 204 and thereby cut the rolled print medium M (step S22). Thereafter, the image forming controller 61 may cause, upon conveying the print medium M in the conveyance direction D, the toner T to be transferred onto the surface of the print medium M and the surface of the conveyance belt 21, and may thereby so form the toner images G1 and G2 as to include the medium toner image GA and the conveyance toner image GB (step S23).

Thereafter, the print medium M may be separated from the conveyance belt 21 owing to the further conveyance of the print medium M, following which the image forming controller 61 may operate the image detection sensors 41 and 42 and thereby detect the medium toner images G1A and G2A formed on the surface of the print medium M (step S24). Thereafter, the image forming controller 61 may calculate the ending time difference ΔTE on the basis of the detection results obtained by the respective image detection sensors 41 and 42 (step S25). Thereafter, the image forming controller 61 may determine whether the ending time difference ΔTE takes a value other than 0 (step S26).

In a case where the ending time difference ΔTE is 0 (step S26: N), the image forming controller 61 may end the adjustment operation of the cutting process, because the print medium M has been cut normally and it is not necessary to perform the adjustment operation of the cutting process accordingly. In a case where the ending time difference ΔTE takes the value other than 0 (step S26: Y), the image forming controller 61 may perform the adjustment operation of the cutting process, because the print medium M has not been cut normally and it is necessary to perform the adjustment operation of the cutting process accordingly. Hence, the image forming controller 61 may so vary one or both of the conveying speed and the cutting speed as to cause the value of the ending time difference ΔTE to be closer to 0 (step S27). Thus, the conveying speed or the cutting speed may be made appropriate, allowing the print medium M to be cut in such a manner that the extending direction of the cut edge MT follows along the width direction when the rolled print medium M is to be cut by the cutter 204 next time and after, and thereby completing the adjustment operation of the cutting process.

Upon performing the adjustment operation of the cutting process, the image forming controller 61 may calculate the detection time difference ΔTC instead of calculating the ending time difference ΔTE. Through calculating the detection time difference ΔTC instead of the ending time difference ΔTE, the image forming controller 61 may vary the conveying speed or the cutting speed on the basis of the detection time difference ΔTC and in accordance with a procedure similar to the example procedure in the first example embodiment (steps S25 to S27). Here, in an alternative example embodiment, the image forming controller 61 may use both of the ending time difference ΔTE and the detection time difference ΔTC upon performing the adjustment operation of the cutting process. Further, in an alternative example embodiment, the image forming controller 61 may vary both of the conveying speed and the cutting speed upon performing the adjustment operation of the cutting process.

[2-3. Example Workings and Example Effects]

In the image forming apparatus according to an example embodiment, the conveying rollers 202 and 203 conveys the print medium M, and the cutter 204 cuts the print medium M. Further, the developing unit 10 and the transfer roller 24 form the toner image G, e.g., the medium toner image GA and the conveyance toner image GB, on the print medium M and the conveyance belt 21. Thereafter, the image detection sensors 40 detects, at the two positions, the medium toner image GA, and the image forming controller 61 varies one or both of the conveying speed and the cutting speed on the basis of the comparison of the medium toner image GA detected at the two positions by the image detection sensors 40. In such an example embodiment, for one reason similar to that described in the first example embodiment, a determination may be made as to whether the print medium M is cut in such a manner that the extending direction of the cut edge MT becomes oblique relative to the width direction, and the cutting process of the print medium M may be adjusted as necessary such that the extending direction of the cut edge MT follows along the width direction. This configuration makes it easier to cut the print medium M by the cutter 204 in such a manner that the extending direction of the cut edge MT follows along the width direction. Hence, it is possible to stably forms an image on the print medium M.

In addition, in an example embodiment, the image detection sensors 40 may detect, at the two positions, the position of the medium toner image GA, and the image forming controller 61 may vary one or both of the conveying speed and the cutting speed on the basis of the comparison between the positions of the medium toner image GA detected at the two positions. Such an example embodiment makes it easier to cut the print medium M such that the extending direction of the cut edge MT follows along the width direction. Further, in an example embodiment, the image detection sensors 40 may detect the detection ending time (e.g., the detection ending time T1E and the detection ending time T2E) at the two positions on the basis of the medium toner images GA, and the image forming controller 61 may calculate the ending time difference ΔTE and may so vary one or both of the conveying speed and the cutting speed as to cause the value of the ending time difference ΔTE to be closer to 0. This configuration makes it easier to cut, stably and with high accuracy, the print medium M in such a manner that the extending direction of the cut edge MT follows along the width direction, and thereby makes it easier to adjust the cutting process of the print medium M. Hence, it is possible to achieve higher effects.

Alternatively, in an example embodiment, the image detection sensors 40 may detect, at the two positions, the lengths of the medium toner image GA, and the image forming controller 61 may vary one or both of the conveying speed and the cutting speed on the basis of the comparison between the lengths of the medium toner image GA detected at the two positions. Such an example embodiment makes it easier to cut the print medium M such that the extending direction of the cut edge MT follows along the width direction. Further, in an example embodiment, the image detection sensors 40 may detect the detection starting time (e.g., the detection starting time T1S and the detection starting time T2S) at the two positions and the detection ending time (e.g., the detection ending time T1E and the detection ending time T2E) at the two positions on the basis of the medium toner image GA, and the image forming controller 61 may calculate the detection time difference ΔTC and may so vary one or both of the conveying speed and the cutting speed as to cause the value of the detection time difference ΔTC to be closer to 0. This configuration makes it easier to cut, stably and with high accuracy, the print medium M in such a manner that the extending direction of the cut edge MT follows along the width direction, and thereby makes it easier to adjust the cutting process of the print medium M. Hence, it is possible to achieve higher effects.

Other example workings and example effects of the image forming apparatus according to the second example embodiment may be the same as or similar to those of the image forming apparatus according to the first example embodiment.

3. IMAGE FORMING APPARATUS (THIRD EXAMPLE EMBODIMENT)

A description is given below of an image forming apparatus according to a third example embodiment of the technology.

[3-1. Configuration]

Figure 28:
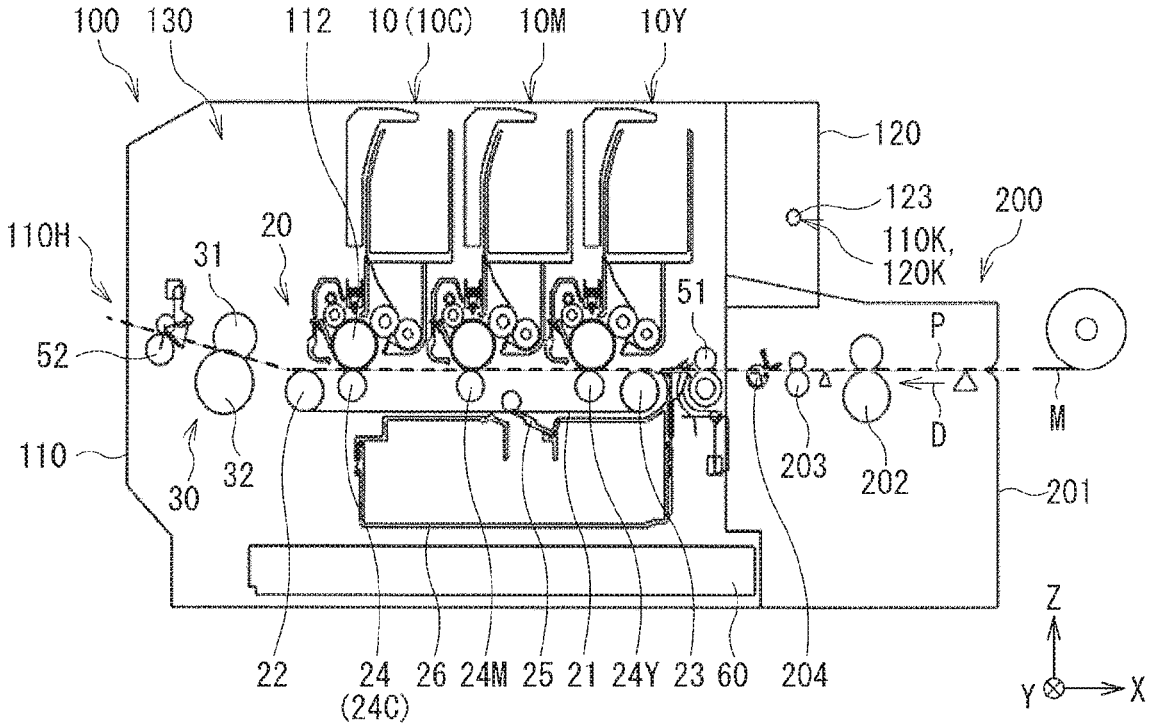
FIG. 28 is a schematic plan view of an example of a configuration of an image forming apparatus according to one embodiment of the technology.

FIG. 28 illustrates an example of a perspective configuration of the image forming apparatus according to the third example embodiment, and corresponds to FIGS. 1 and 21. The image forming apparatus according to the third example embodiment may have a configuration similar to the configuration of each of the first and the second example embodiments, with the exception that the image forming apparatus according to the third example embodiment does not include the image detection sensors 40 as illustrated in FIG. 28.

The image forming apparatus according to each of the first and the second example embodiments includes the image detection sensors 40 for the image forming controller 61 to perform the adjustment operation of the cutting process, i.e., for the image forming apparatus to automatically perform the adjustment operation of the cutting process without any intervention of human-induced operation. In contrast, the image forming apparatus according to the third example embodiment does not include the image detection sensors 40 to thereby allow for the adjustment operation of the cutting process through a human-induced operation, i.e., to thereby allows a user who uses the image forming apparatus to manually perform the adjustment operation of the cutting process as described below.

[3-2. Operation]

Figure 29:
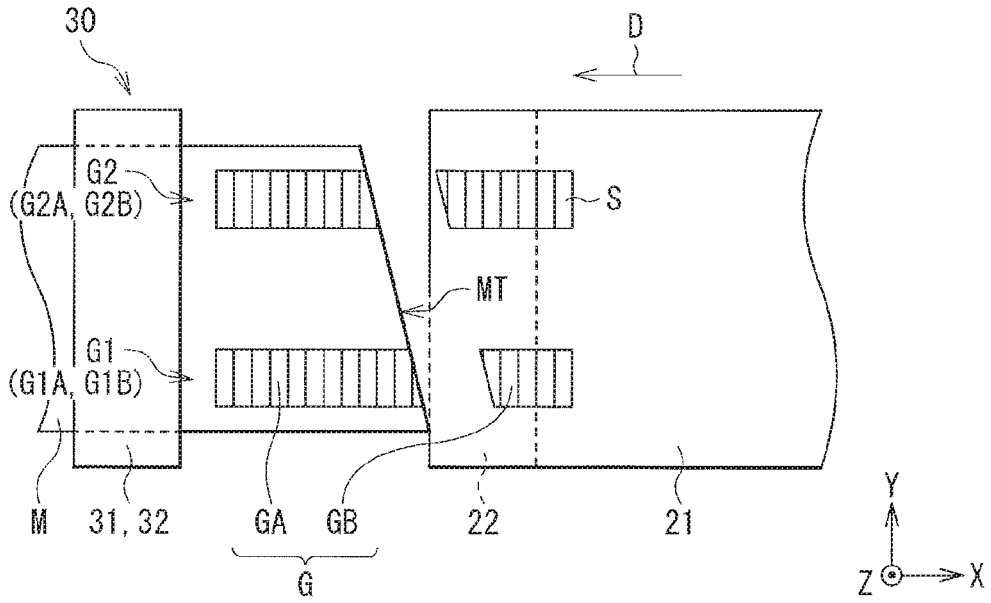
FIG. 29 is a plan view for describing an example of an adjustment procedure in the cutting process.
Figure 30:
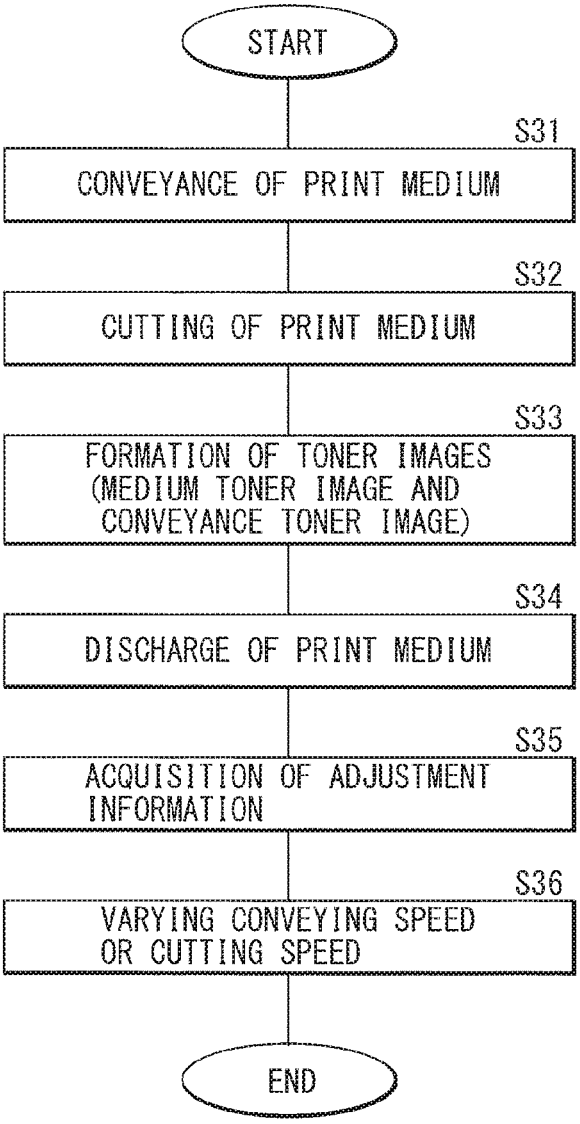
FIG. 30 is a flowchart illustrating an example of a flow of the adjustment operation of the cutting process.

FIG. 29 illustrates an example of a plan configuration corresponding to FIG. 16 for describing an example of an adjustment procedure in the cutting process. FIG. 30 illustrates an example of a flow of the adjustment operation of the cutting process for describing the example adjustment operation of the cutting process. It is to be noted that FIG. 29 illustrates a non-limiting example in which an example configuration of the toner image G illustrated in FIG. 12 is applied. In other words, in this example case, the toner image G includes the scaled pattern having the plurality of frame-shaped scales S. It is to be also noted that step numbers in parentheses described below correspond to those illustrated in FIG. 30.

Operations of forming an image performed by the image forming apparatus according to the third example embodiment may be similar to the example operations to be performed by the image forming apparatus according to the first example embodiment. Further, the image forming apparatus according to the third example embodiment may perform the adjustment operation of the cutting process in accordance with an example procedure to be described below. In the following description, any operation similar to that performed in each of the first and the second example embodiments will be described in a simplified fashion as necessary.

Upon performing the adjustment operation of the cutting process, the image forming controller 61 may first rotate the conveying rollers 202 and 203 to thereby convey the rolled print medium M (step S31). During the conveyance of the rolled print medium M, the image forming controller 61 may cut the rolled print medium M by means of the cutter 204 (step S32). Thereafter, the image forming controller 61 may cause the toner T to be transferred onto the surface of the print medium M and the surface of the conveyance belt 21, and may thereby form the toner images G1 and G2, e.g., the medium toner image GA and the conveyance toner image GB (step S33). Thereafter, the print medium M may be further conveyed in the conveyance direction D and may be thus separated from the conveyance belt 21, following which the print medium M may be discharged from the discharge opening 110H (step S34).

For example, when the user obtains the print medium M on which the medium toner images G1A and G2A are formed, the user may operate the operation interface panel 122 on the basis of those medium toner images G1A and G2A to thereby input adjustment information. The adjustment information may be information equivalent to the starting time difference ΔTS, the ending time difference ΔTE, and the detection time difference ΔTC which are described above. In other words, the adjustment information may be any information necessary for the image forming apparatus, e.g., for the image forming controller 61, to perform the adjustment operation of the cutting process. The adjustment information may include any content and hence the content of the adjustment information is not particularly limited, as long as the image forming controller 61 is able to execute the adjustment operation of the cutting process on the basis of the adjustment information.

In an example embodiment, the adjustment information may be directed to a difference (i.e., a number difference) between the number of scales S included in the medium toner image G1A and the number of scales S included in the medium toner image G2A in a non-limiting example where the toner image G has the scaled pattern as illustrated in FIG. 29. Note that the number of scales S here refers to the number of complete scales S included in each of the medium toner images G1A and G2A, and that the number of partial scales S included in each of the medium toner images G1A and G2A is uncounted, for example.

For example, in an example case illustrated in FIG. 29, the medium toner image G1A includes ten scales S whereas the medium toner image G2A includes eight scales S. Hence, the number difference (=the number of scales S included in the medium toner image G1A−the number of scales S included in the medium toner image G2A) is two (10−8). Note that the number difference is not necessarily limited to a positive number and can be a negative number in some cases.

In an alternative example embodiment where an example configuration of the toner image G illustrated in any of FIGS. 7 and 8 is applied (i.e., the toner image G includes the solid pattern), the adjustment information may be directed to a difference (i.e., a length difference) between the length of the medium toner image G1A and the length of the medium toner image G2A. For example, to determine the length difference, the lengths of the respective medium toner images G1A and G2A each may be measured using any measuring instrument such as a ruler, and the length difference may be calculated thereafter on the basis of a result of the length measurement of each of the medium toner images G1A and G2A.

Thereafter, the image forming controller 61 may acquire the adjustment information inputted from the user through the operation interface panel 122 (step S35). Upon receiving the adjustment information, the image forming controller 61 may vary the conveying speed on the basis of the adjustment information (step S36). For example, in an example case where the image forming controller 61 has acquired the number difference inputted by the user, the image forming controller 61 may so vary the conveying speed as to cause the value of the number difference to be closer to 0, because the print medium M has been cut in such a manner that the extending direction of the cut edge MT becomes oblique, relative to the width direction, by a magnitude corresponding to the number difference and it is necessary to perform the adjustment operation of the cutting process accordingly. Note that a level of decreasing the number difference may be the same or similar to what has been described in detail in the first example embodiment with respect to the level of decreasing the starting time difference ΔTS. Thus, the print medium M is cut in such a manner that the extending direction of the cut edge MT follows along the width direction, thereby completing the adjustment operation of the cutting process.

Upon performing the adjustment operation of the cutting process, the image forming controller 61 may vary the cutting speed (step S36) instead of varying the conveying speed. Further, the image forming controller 61 may vary both of the conveying speed and the cutting speed upon performing the adjustment operation of the cutting process.

[3-3. Example Workings and Example Effects]

In the image forming apparatus according to the third example embodiment, the conveying rollers 202 and 203 conveys the print medium M, and the cutter 204 cuts the print medium M. Further, the developing unit 10 and the transfer roller 24 form the toner image G including the medium toner image GA and the conveyance toner image GB, on the print medium M and the conveyance belt 21. Thereafter, upon the acquisition by the image forming controller 61 of the adjustment information inputted by the user on the basis of the medium toner image GA, the image forming controller 61 varies one or both of the conveying speed and the cutting speed on the basis of the adjustment information. In such an example embodiment as well, for one reason similar to that described in the first and the second example embodiments, a determination may be made as to whether the print medium M is cut in such a manner that the extending direction of the cut edge MT becomes oblique relative to the width direction, and the cutting process of the print medium M may be adjusted as necessary such that the extending direction of the cut edge MT follows along the width direction. This configuration makes it easier to cut the print medium M by the cutter 204 in such a manner that the extending direction of the cut edge MT follows along the width direction. Hence, it is possible to stably forms an image on the print medium M.

Other example workings and example effects may be the same as or similar to those of the image forming apparatus according to the first example embodiment, except for example workings and example effects which are derived from the utilization of the detection results obtained by the image detection sensors 40.

4. IMAGE FORMING APPARATUS (FOURTH EXAMPLE EMBODIMENT)

A description is given below of an image forming apparatus according to a fourth example embodiment of the technology.

In the third example embodiment, the user inputs the adjustment information on the basis of the medium toner image GA (e.g., the medium toner images G1A and G2A), and the image forming controller 61 varies one or both of the conveying speed and the cutting speed on the basis of the adjustment information. In the fourth example embodiment, the user may input the adjustment information on the basis of the conveyance toner image GB (e.g., the conveyance toner images G1B and G2B) instead of inputting the adjustment information on the basis of the medium toner image GA (e.g., the medium toner images G1A and G2A), and the image forming controller 61 may vary one or both of the conveying speed and the cutting speed on the basis of such adjustment information.

A configuration and an operation of the image forming apparatus according to the fourth example embodiment may be similar to those of the image forming apparatus according to the third example embodiment, except for the following respects.

For example, upon inputting by the user of the adjustment information on the basis of the conveyance toner images G1B and G2B, the toner image G including the medium toner image GA and the conveyance toner image GB may be formed, following which the user may open the top cover 120 and may visually confirm the conveyance toner images G1B and G2B formed on the surface of the conveyance belt 21. Note that the adjustment information in the fourth example embodiment may be the same or similar to what has been described in detail with respect to the adjustment information in the third example embodiment, except for the use of the conveyance toner images G1B and G2B instead of the medium toner images G1A and G2A. The fourth example embodiment thus makes it possible for the user to input the adjustment information even in an example case where the user has lost the print medium M that is formed with the medium toner images G1A and G2A and discharged from the discharge opening 110H.

In the image forming apparatus according to the fourth example embodiment, the conveying rollers 202 and 203 conveys the print medium M. and the cutter 204 cuts the print medium M. Further, the developing unit 10 and the transfer roller 24 form the toner image G including the medium toner image GA and the conveyance toner image GB, on the print medium M and the conveyance belt 21. Thereafter, upon the acquisition by the image forming controller 61 of the adjustment information inputted by the user on the basis of the conveyance toner image GB, the image forming controller 61 varies one or both of the conveying speed and the cutting speed on the basis of the adjustment information. Thus, for one reason similar to that described in the third example embodiment, the cutting process of the print medium M may be adjusted as necessary such that the extending direction of the cut edge MT follows along the width direction. Hence, it is possible to stably forms an image on the print medium M.

Other example workings and example effects may be the same as or similar to those of the image forming apparatus according to the third example embodiment.

5. MODIFICATION EXAMPLES

The configuration of the image forming apparatus according to any of the foregoing example embodiments may be variously modified as necessary as an example embodiment of the technology.

First Modification Example

In the first example embodiment, the image forming controller 61 performs the adjustment operation of the cutting process, on the basis of the detection results related to the conveyance toner image GB obtained by the image detection sensors 40. In the second example embodiment, the image forming controller 61 performs the adjustment operation of the cutting process, on the basis of the detection results related to the medium toner image GA obtained by the image detection sensors 40.

In the first modification example, however, the image detection sensor 40 directed to the detection of the conveyance toner image GB and the image detection sensor 40 directed to the detection of the medium toner image GA may be used in combination. Further, the image forming controller 61 may perform the adjustment operation of the cutting process, on the basis of both the detection result on the conveyance toner image GB and the detection result on the medium toner image GA. This configuration according to the first modification example also makes it easier to cut the print medium M by the cutter 204 in such a manner that the extending direction of the cut edge MT follows along the width direction. Hence, it is possible to achieve example effects similar to those described above.

Second Modification Example

Some non-limiting examples of the configuration of the toner image G have been described above with reference to FIGS. 6 to 14. However, the toner image G may have any configuration and hence the configuration of the toner image G is not particularly limited, as long as a difference in configuration of the toner image G is detectable or visually recognizable at positions that are different from each other in the width direction and as long as it is possible to perform the adjustment operation of the cutting process on the basis of a result of such detection or visual recognition.

Figure 31:
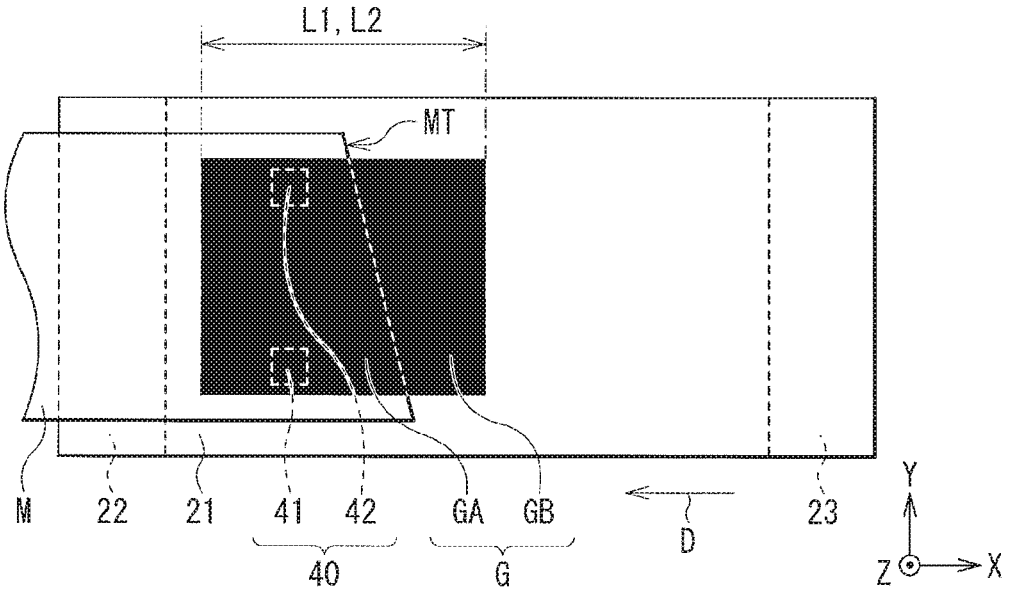
FIG. 31 is a plan view of a configuration of the toner image according to a modification example.

For example, only one toner image G may be formed as illustrated by way of example in FIG. 31 that corresponds to FIG. 6. In such an example embodiment where the number of toner images G is one, a width (e.g., a size in the Y-axis direction) of the toner image G may be sufficiently large such that the image detection sensor 40 or the image detection sensors 40 is/are able to detect the toner image G at two or more positions that are different from each other in the width direction.

Figure 32:
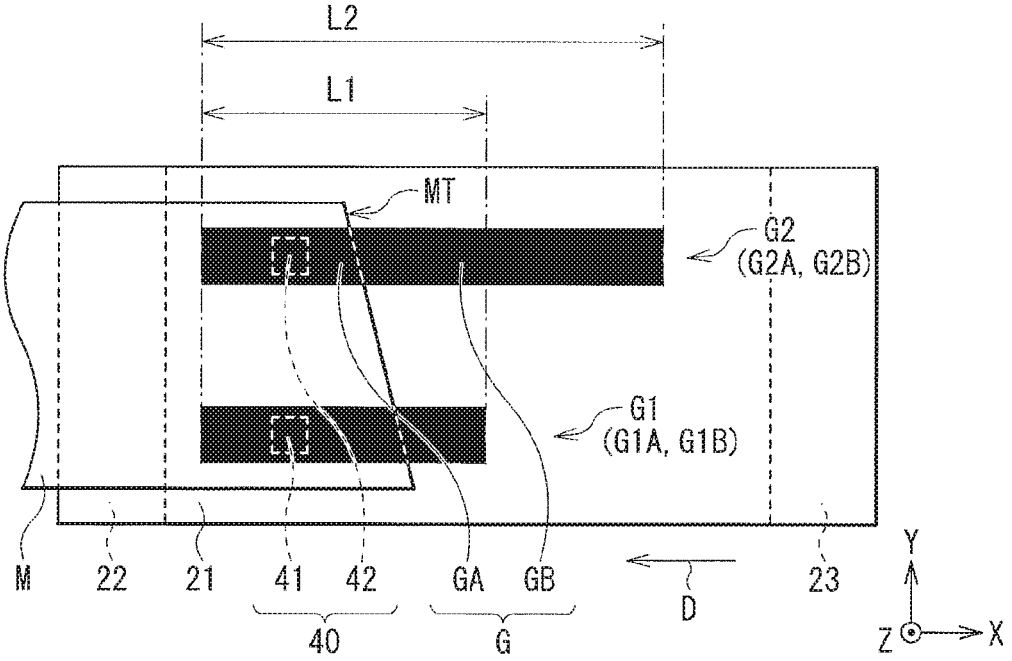
FIG. 32 is a plan view of a configuration of the toner image according to another modification example.

Further, for example, the length L1 of the toner image G1 and the length L2 of the toner image G2 may be different from each other as illustrated by way of example in FIG. 32 that corresponds to FIG. 6. FIG. 32 illustrates an example embodiment in which the length L2 is larger than the length L1. In an unillustrated alternative example embodiment, the length L1 may be larger than the length L2.

Note that a region in which the toner image G2 is formed extends toward the upstream side in the conveyance direction D in the example embodiment illustrated in FIG. 32. In an alternative example embodiment, however, the region in which the toner image G2 is formed may extend toward the downstream side in the conveyance direction D, or may extend toward each of the upstream and the downstream sides. Hence, a direction or directions of the extension of the formation region is/are not particularly limited. This applies similarly to a region in which the toner image G1 is formed as well, where the length L1 is larger than the length L2.

Figure 33:
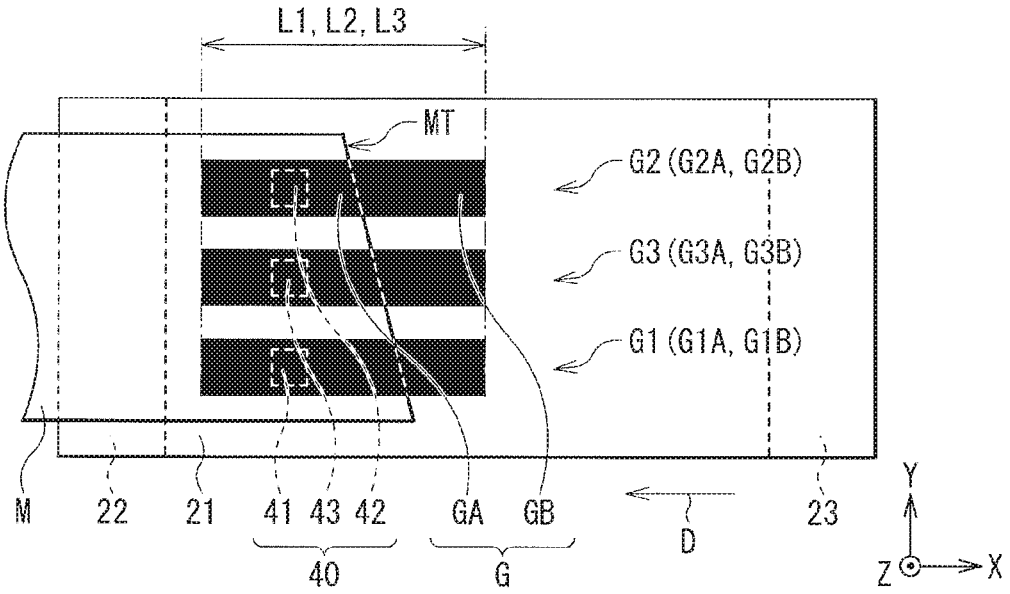
FIG. 33 is a plan view of a configuration of the toner image according to yet another modification example.

In addition, for example, three or more toner images G may be formed as illustrated by way of example in FIG. 33 that corresponds to FIG. 6. FIG. 33 illustrates an example embodiment in which three toner images G (toner images G1 to G3) and three image detection sensors 40 (image detection sensors 41 to 43) corresponding to the number of such toner images G1 to G3 are provided. In other words, the number of image detection sensors 40 is not limited to two and can be three or more.

In such example embodiments as well, the adjustment operation of the cutting process similar to an example embodiment illustrated by way of example in FIG. 6 is performed. Hence, it is possible to achieve example effects that are similar to those of any example embodiment.

Third Modification Example

The image forming controller 61 automatically performs the adjustment operation of the cutting process at any timing in each of the first and the second example embodiments. In a third modification example, however, the image forming controller 61 may perform the adjustment operation of the cutting process when the user has instructed to execute the adjustment operation through the operation interface panel 122. In such an example embodiment, for example, the image detection sensors 40 may perform the detection of the toner image G and the image forming controller 61 may perform the adjustment operation of the cutting process, when the user has inputted the instructions on the execution of the adjustment operation. Alternatively, for example, the image forming controller 61 may perform the adjustment operation of the cutting process, on a condition that the image detection sensors 40 have already performed the detection of the toner image G at any timing and when the user has inputted the instructions on the execution of the adjustment operation.

In such example embodiments as well, the adjustment operation of the cutting process is performed on the basis of the detection results obtained by the image detection sensors 40. Hence, it is possible to achieve example effects that are similar to those of any example embodiment.

Fourth Modification Example

In each of the second and the third example embodiments, the toner T is transferred from the surface of the print medium M through the cut edge MT to the surface of the conveyance belt 21 to thereby so form the toner image G as to include the medium toner image GA and the conveyance toner image GB as illustrated in FIGS. 6 and 29.

Figure 34:
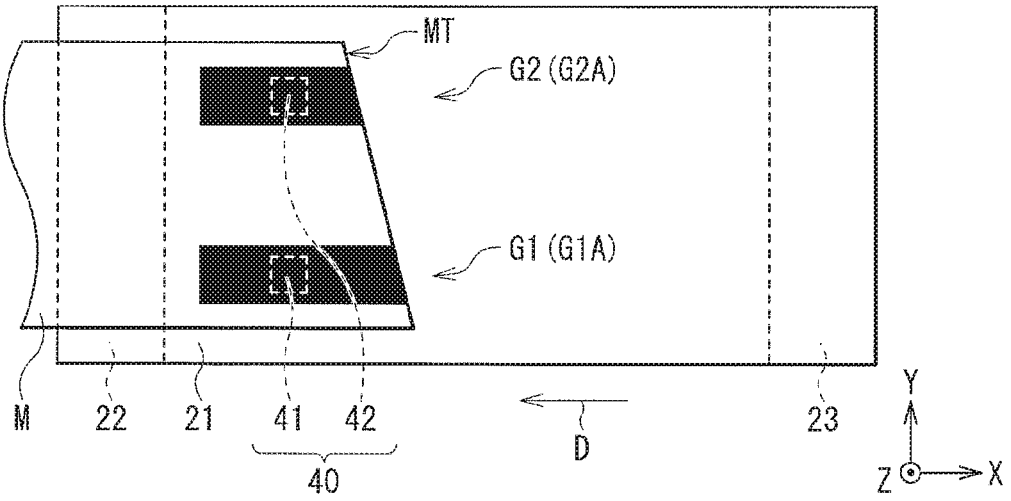
FIG. 34 is a plan view of a configuration of the toner image according to yet another modification example.

In a fourth modification example, however, the toner T may be transferred from an inner side of the surface of the print medium M to an edge of the surface of the print medium M (e.g., the cut edge MT) in the conveyance direction D to thereby form the toner image G (e.g., the medium toner image GA) only on the print medium M, as illustrated by way of example in FIG. 34 that corresponds to FIG. 6. In such an example embodiment as well, the adjustment operation of the cutting process is performed on the basis of the medium toner image GA as with each of the second and the third example embodiments. Hence, it is possible to achieve example effects that are similar to those of any example embodiment.

Fifth Modification Example

The width direction in which the image detection sensors 40 are disposed away from each other is not limited to the direction orthogonal to the conveyance direction D. In a fifth modification example, the width direction may be at an angle relative to the conveyance direction D. For example, the image detection sensors 40 may perform the detection at respective positions that are shifted from each other in the conveyance direction D. The fifth modification example also varies one or both of the conveying speed and the cutting speed while taking into consideration the shift in the positions at which the respective image detection sensors 40 perform the detection. Hence, it is possible to achieve example effects similar to those described above.

Some example embodiments and the modification examples thereof of the technology have been described above; however, embodiments of the technology are not limited to the example embodiments and the modification examples described above, and is modifiable in various ways. For example, the image forming apparatus according to an example embodiment of the technology may include no medium feeding unit. In such an example embodiment where no medium feeding unit is provided, the image forming apparatus may contain a plurality of print media that have been so cut in advance as to have a predetermined size. Further, for example, the image forming apparatus according to any embodiment of the technology is not limited to a printer, and may be any other apparatus such as a copying machine, a facsimile, a multi-functional peripheral, or any other apparatus having an image-forming functionality.

Furthermore, the technology encompasses any possible combination of some or all of the various embodiments and the modifications described herein and incorporated herein.

It is possible to achieve at least the following configurations from the above-described example embodiments and the modification examples of the technology.

(1) An image forming apparatus including:

a first conveyor that conveys a print medium;

a cutter that cuts the print medium conveyed by the first conveyor;

a second conveyor that conveys, in a first direction, the print medium cut by the cutter;

a detection image forming section that forms a detection image on each of the print medium cut by the cutter and the second conveyor;

a detector that detects, at two positions that are in a second direction, one of the detection image formed on the print medium cut by the cutter and the detection image formed on the second conveyor, the second direction being substantially orthogonal to the first direction; and a controller that varies one or both of a conveying speed of the print medium to be conveyed by the first conveyor and a cutting speed of the print medium to be cut by the cutter, on a basis of a comparison of the detection image detected at the two positions by the detector.

(2) The image forming apparatus according to (1), in which the detector detects, at the respective two positions, positions of the detection image on a basis of the detection image formed on the second conveyor, and the controller varies one or both of the conveying speed and the cutting speed, on the basis of the comparison between the positions, detected at the respective two positions by the detector, of the detection image.

(3) The image forming apparatus according to (2), in which the detector detects, at the respective two positions, timings at which the detection of the detection image is started, and the controller calculates a difference between the timings at which the detection, at the respective two positions, of the detection image is started, and varies one or both of the conveying speed and the cutting speed to thereby cause the difference to be closer to zero.

(4) The image forming apparatus according to (1), in which the detector detects, at the respective two positions, formation sizes, in the first direction, of the detection image on a basis of the detection image formed on the second conveyor, and the controller calculates a difference between the formation sizes at the respective two positions of the detection image, and varies one or both of the conveying speed and the cutting speed to thereby cause the difference to be closer to zero.

(5) The image forming apparatus according to (1), in which the detector detects, at the respective two positions, positions of the detection image on a basis of the detection image formed on the print medium cut by the cutter, and the controller varies one or both of the conveying speed and the cutting speed, on the basis of the comparison between the positions, detected at the respective two positions by the detector, of the detection image.

(6) The image forming apparatus according to (5), in which the detector detects, at the respective two positions, timings at which the detection of the detection image is ended, and the controller calculates a difference between the timings at which the detection, at the respective two positions, of the detection image is ended, and varies one or both of the conveying speed and the cutting speed to thereby cause the difference to be closer to zero.

(7) The image forming apparatus according to (1), in which the detector detects, at the respective two positions, formation sizes, in the first direction, of the detection image on a basis of the detection image formed on the print medium cut by the cutter, and the controller calculates a difference between the formation sizes at the respective two positions of the detection image, and varies one or both of the conveying speed and the cutting speed to thereby cause the difference to be closer to zero.

(8) The image forming apparatus according to any one of (1) to (7), in which the controller varies the conveying speed.

(9) The image forming apparatus according to any one of (1) to (8), in which the cutter includes a rotary cutter that is rotatable and cuts the print medium upon the conveyance of the print medium by the first conveyor, and the controller varies a rotation speed of the rotary cutter and thereby varies the cutting speed.

(10) The image forming apparatus according to any one of (1) to (9), in which the detection image includes a first detection image and a second detection image that are separated away from each other in the second direction, and the detector includes a first detector that detects the first detection image and a second detector that detects the second detection image.

(11) The image forming apparatus according to any one of (1) to (10), in which the detection image extends continuously from the print medium cut by the cutter to the second conveyor.

(12) The image forming apparatus according to any one of (1) to (10), in which the detection image extends intermittently from the print medium cut by the cutter to the second conveyor.

(13) An image forming apparatus including:

a first conveyor that conveys a print medium;

a cutter that cuts the print medium conveyed by the first conveyor:

a second conveyor that conveys the print medium cut by the cutter:

a detection image forming section that forms a detection image on each of the print medium cut by the cutter and the second conveyor; and a controller that varies one or both of a conveying speed of the print medium to be conveyed by the first conveyor and a cutting speed of the print medium to be cut by the cutter.

(14) An image forming apparatus including:

a first conveyor that conveys a print medium:

a cutter that cuts the print medium conveyed by the first conveyor;

a second conveyor that conveys, in a first direction, the print medium cut by the cutter;

a detection image forming section that forms a detection image on the print medium cut by the cutter;

a detector that detects, at two positions that are in a second direction, the detection image, the second direction being substantially orthogonal to the first direction; and a controller that varies one or both of a conveying speed of the print medium to be conveyed by the first conveyor and a cutting speed of the print medium to be cut by the cutter, on a basis of a comparison of the detection image detected at the two positions by the detector.

The image forming apparatus according to one embodiment of the technology includes the first conveyor that conveys the print medium and the cutter that cuts the print medium. Further, the detection image forming section forms the detection image on each of the print medium cut by the cutter and the second conveyor, and the detector detects, at the two positions, one of the detection image formed on the print medium and the detection image formed on the second conveyor. The controller varies one or both of the conveying speed of the print medium and the cutting speed of the print medium, on the basis of the comparison of the detection image detected at the two positions by the detector. Hence, it is possible to stably form an image on the print medium.

The image forming apparatus according to one embodiment of the technology includes the first conveyor that conveys the print medium and the cutter that cuts the print medium. Further, the detection image forming section forms the detection image on each of the print medium cut by the cutter and the second conveyor, and the controller varies one or both of the conveying speed of the print medium and the cutting speed of the print medium. Hence, it is possible to stably form an image on the print medium.

The image forming apparatus according to one embodiment of the technology includes the first conveyor that conveys the print medium and the cutter that cuts the print medium. Further, the detection image forming section forms the detection image on the print medium cut by the cutter, and the detector detects, at the two positions, the detection image formed on the print medium. The controller varies one or both of the conveying speed of the print medium and the cutting speed of the print medium, on the basis of the comparison of the detection image detected at the two positions by the detector. Hence, it is possible to stably form an image on the print medium.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

a first conveyor that conveys a print medium;

a cutter that cuts the print medium conveyed by the first conveyor;

a second conveyor that conveys, in a first direction, the print medium cut by the cutter;

a detection image forming section that forms a detection image on each of the print medium cut by the cutter and the second conveyor;

a detector that detects, at two positions that are in a second direction, one of the detection image formed on the print medium cut by the cutter and the detection image formed on the second conveyor, the second direction being substantially orthogonal to the first direction; and a controller that varies one or both of a conveying speed of the print medium to be conveyed by the first conveyor and a cutting speed of the print medium to be cut by the cutter, on a basis of a comparison of the detection image detected at the two positions by the detector.

2. The image forming apparatus according to claim 1, wherein the detector detects, at the respective two positions, positions of the detection image on a basis of the detection image formed on the second conveyor, and the controller varies one or both of the conveying speed and the cutting speed, on the basis of the comparison between the positions, detected at the respective two positions by the detector, of the detection image.

3. The image forming apparatus according to claim 2, wherein the detector detects, at the respective two positions, timings at which the detection of the detection image is started, and the controller calculates a difference between the timings at which the detection, at the respective two positions, of the detection image is started, and varies one or both of the conveying speed and the cutting speed to thereby cause the difference to be closer to zero.

4. The image forming apparatus according to claim 1, wherein the detector detects, at the respective two positions, formation sizes, in the first direction, of the detection image on a basis of the detection image formed on the second conveyor, and the controller calculates a difference between the formation sizes at the respective two positions of the detection image, and varies one or both of the conveying speed and the cutting speed to thereby cause the difference to be closer to zero.

5. The image forming apparatus according to claim 1, wherein the detector detects, at the respective two positions, positions of the detection image on a basis of the detection image formed on the print medium cut by the cutter, and the controller varies one or both of the conveying speed and the cutting speed, on the basis of the comparison between the positions, detected at the respective two positions by the detector, of the detection image.

6. The image forming apparatus according to claim 5, wherein the detector detects, at the respective two positions, timings at which the detection of the detection image is ended, and the controller calculates a difference between the timings at which the detection, at the respective two positions, of the detection image is ended, and varies one or both of the conveying speed and the cutting speed to thereby cause the difference to be closer to zero.

7. The image forming apparatus according to claim 1, wherein the detector detects, at the respective two positions, formation sizes, in the first direction, of the detection image on a basis of the detection image formed on the print medium cut by the cutter, and the controller calculates a difference between the formation sizes at the respective two positions of the detection image, and varies one or both of the conveying speed and the cutting speed to thereby cause the difference to be closer to zero.

8. The image forming apparatus according to claim 1, wherein the controller varies the conveying speed.

9. The image forming apparatus according to claim 1, wherein the cutter comprises a rotary cutter that is rotatable and cuts the print medium upon the conveyance of the print medium by the first conveyor, and the controller varies a rotation speed of the rotary cutter and thereby varies the cutting speed.

10. The image forming apparatus according to claim 1, wherein the detection image comprises a first detection image and a second detection image that are separated away from each other in the second direction, and the detector comprises a first detector that detects the first detection image and a second detector that detects the second detection image.

11. The image forming apparatus according to claim 1, wherein the detection image extends continuously from the print medium cut by the cutter to the second conveyor.

12. The image forming apparatus according to claim 1, wherein the detection image extends intermittently from the print medium cut by the cutter to the second conveyor.

13. An image forming apparatus comprising:

a first conveyor that conveys a print medium;

a cutter that cuts the print medium conveyed by the first conveyor;

a second conveyor that conveys, in a first direction, the print medium cut by the cutter;

a detection image forming section that forms a detection image on the print medium cut by the cutter;

a detector that detects, at two positions that are in a second direction, the detection image, the second direction being substantially orthogonal to the first direction; and a controller that varies one or both of a conveying speed of the print medium to be conveyed by the first conveyor and a cutting speed of the print medium to be cut by the cutter, on a basis of a comparison of the detection image detected at the two positions by the detector.

* * * * *